US005848929A

United States Patent [19]

Hoffman

[11] Patent Number: 5,848,929

[45] Date of Patent: Dec. 15, 1998

[54] CENTRIFUGAL FINISHER WITH FIXED OUTER VESSEL AND ROTATABLE INNER VESSEL

[75] Inventor: Steve E. Hoffman, Englewood Cliffs, N.J.

[73] Assignee: H Technology, Boonton, N.J.

[21] Appl. No.: 823,515

[22] Filed: Mar. 24, 1997

[51] Int. Cl.[6] ..... B24B 31/033

[52] U.S. Cl. ..... 451/32; 451/328; 451/329; 451/327; 451/113; 451/104

[58] Field of Search ..... 451/32, 326, 327, 451/328, 329, 330, 113, 104, 286

[56] References Cited

U.S. PATENT DOCUMENTS

| | | | |
|---|---|---|---|
| 4,172,339 | 10/1979 | Balz | 451/329 |
| 5,140,783 | 8/1992 | Hoffman . | |
| 5,295,330 | 3/1994 | Hoffman . | |
| 5,355,638 | 10/1994 | Hoffman . | |
| 5,507,685 | 4/1996 | Hoffman . | |
| 5,531,637 | 7/1996 | Kimura | 451/329 |
| 5,672,094 | 9/1997 | Nishimura et al. | 451/328 |

FOREIGN PATENT DOCUMENTS

| | | | |
|---|---|---|---|
| 346001559 | 1/1971 | Japan | 451/328 |
| 363084871 | 4/1988 | Japan | 451/328 |
| 404275868 | 10/1992 | Japan | 451/328 |
| 1771927 | 10/1992 | Russian Federation | 451/329 |

*Primary Examiner*—Robert A. Rose
*Assistant Examiner*—George Nguyen
*Attorney, Agent, or Firm*—Morgan & Finnegan, L.L.P.

[57] ABSTRACT

A centrifugal finisher uses centrifugal and rotational forces for finishing at least one object. A fixed, non-rotatably outer vessel has an inner surface and a central axis. At least one inner vessel is positioned inside the outer vessel and is adapted to hold an object to be finished. The inner vessel has an outer surface. At least one intermediate roller is positioned between the inner surface of the outer vessel and the outer surface of the inner vessel and engages the surfaces of respective outer and inner vessels. A drive mechanism rotates the inner vessel around the central axis of the outer vessel, thereby causing rotation of the inner vessel by engagement of the inner vessel with the intermediate roller which moves by rotation along the inner surface of the outer vessel.

17 Claims, 34 Drawing Sheets

Rq: 1.51 um
Ra: 1.19 um
Rt: 8.15 um
Rp: 3.38 um
Rv: −4.77 um

Rq: 1.56 um
Ra: 1.01 um
Rt: 10.01 um
Rp: 2.23 um
Rv: −7.78 um

Rq: 1.29 um
Ra: 1.11 um
Rt: 5.17 um
Rp: 1.87 um
Rv: −3.29 um

| | | |
|---|---|---|
| HORIZONTAL DISTANCE(nm) | 1172 | SPECTRAL PERIOD(nm) |
| VERTICAL DISTANCE(nm) | 1103 | DC |
| ANGLE(deg) | 43.01 | |

| | | |
|---|---|---|
| HORIZONTAL DISTANCE(nm) | 100.00 | SPECTRAL PERIOD(nm) |
| VERTICAL DISTANCE(nm) | 1.37 | DC |
| ANGLE(deg) | 0.79 | |

| | | |
|---|---|---|
| HORIZONTAL DISTANCE(nm) | 200.00 | SPECTRAL PERIOD(nm) |
| VERTICAL DISTANCE(nm) | 3.78 | DC |
| ANGLE(deg) | 1.07 | |

| STANDARD ROUGHNESS | |
|---|---|
| Ra: | 0.28 nm |
| Rp: | 1.47 nm |
| Rpm: | 0.61 nm |
| Rt: | 2.15 nm |
| Rtm: | 1.29 nm |

| STANDARD ROUGHNESS | |
|---|---|
| Ra: | 0.31 nm |
| Rp: | 0.94 nm |
| Rpm: | 0.62 nm |
| Rt: | 1.61 nm |
| Rtm: | 1.18 nm |

| STANDARD ROUGHNESS | |
|---|---|
| Ra: | 0.25 nm |
| Rp: | 1.03 nm |
| Rpm: | 0.71 nm |
| Rt: | 2.15 nm |
| Rtm: | 1.40 nm |

BUFFER 6 (SAFRUF .001(F)), ROTATED 0, XY AXES [nm], Z AXIS [nm]

BUFFER 1 (SAFINT2 .002(F)), ROTATED 0, XY AXES [nm], Z AXIS [nm]

CENTRIFUGAL FINISHER WITH FIXED OUTER VESSEL AND ROTATABLE INNER VESSEL

FIELD OF THE INVENTION

The present invention relates to an apparatus for finishing the surface of an object by contact with abrasive pieces caused by centrifugal and rotational forces.

BACKGROUND OF THE INVENTION

Surface finishing a product can be an essential step in its manufacture as a final commercial product. In some instances, it is essential to finish the product to a smooth surface without deforming the characteristics of the material to its end purpose. Some finishing machinery use the centrifugal force imparted by a rotating vessel to finish products. Some of these machines subject objects to both centrifugal and rotational forces using a complicated set of gears. These types of machines are limited to a particular ratio of revolutional speed to rotational speed. Also, these machines are complicated and require many moving parts. They are quite noisy. Other types of machines create centrifugal forces by revolving a vessel around a shaft and creating rotational forces using a belt wrapped around the shaft and the exterior of the vessel. The speed of the belt is related to the speed of the shaft. Overheating is common in these types of machines.

One successful machine using both centrifugal and rotational forces in a simple design without a system of gears and which can be operated at very high speeds is disclosed in U.S. Pat. No. 5,355,638 to Hoffman, the disclosure which is hereby incorporated by reference in its entirety.

As disclosed in that '638 patent, the centrifugal finisher (or polisher) has an outer vessel that is rotatable, and at least one inner vessel that is revolved about the axis of the rotatable outer vessel and rotated about its own axis. A traction surface exists between the inner surface of the outer vessel and the outer surface of the inner vessel. The traction surface allows the outer vessel to restrain the inner vessel while the inner vessel experiences centrifugal forces. This machine simultaneously causes the rotational movement of the inner vessel to transfer momentum from the outer vessel to the inner vessel because the outer vessel is rotated at a different speed and possibly a different direction than the rotational movement thus causing the revolution of the inner vessel.

This invention discloses an apparatus where a center drive can be used for rotating the outer vessel and the inner vessel. One drawback of this type of machine is its size limitation because the outer vessel must be designed to rotate. For large objects, this becomes impractical and expensive. Additionally, the invention disclosed in the '638 patent has inner and outer vessels engaging each other causing an inability to control rotation of the inner vessel unless you rotate the outer vessel. Also, a traction surface is necessary, and as is explained in detail in the '638 patent, requires a band of resilient material having a high coefficient of friction. The traction surface maximizes pressure between the inner vessel and outer vessel walls to create the drive relationship. Also, the operation of the whole unit is constrained by the total RPM the unit can operate, and especially the outer vessel which can be difficult to manage when greater diameters are required.

It would be advantageous if a centrifugal finisher could be designed that overcomes the disadvantages of the finisher disclosed in the '638 patent. It would be advantageous if a traction surface was not necessary. If the outer vessel did not rotate and could be fixed, then much larger objects could be finished without requiring massive amounts of energy and force applied to the unit. Additionally, it would be advantageous if the inner vessel could be removed so that other vessels of various diameters could be inserted within the unit without necessarily having to change the outer vessel. In the '638 patent, the inner vessels are mounted on respective bearing supports that are mounted on arms connected to a centrally driven hub.

SUMMARY OF THE INVENTION

The centrifugal finisher of the present invention now allows an object or plurality of objects to be finished by contact with abrasive pieces caused by centrifugal and rotational forces using a fixed, non-rotatable outer vessel having an inner surface and a central axis. In accordance with the present invention, at least one inner vessel is positioned inside the outer vessel and contains an object to be finished. The inner vessel has an outer surface. At least one intermediate roller is positioned between the inner surface of the outer vessel and the outer surface of an inner vessel and engages the surfaces of respective outer and inner vessels. A drive mechanism then rotates each of the inner vessels around the central axis of the outer vessel by causing rotation of the inner vessels and engaging each of the inner vessels with at least one intermediate roller rotating along the inner surface of the outer vessel. The drive mechanism can include a mechanism for biasing the inner vessel against the intermediate roller as the intermediate roller engages the inner surface of the outer vessel and the outer surface of the inner vessel.

In one aspect of the present invention, two intermediate rollers engage an inner vessel and provide two contact points against the inner surface of the outer vessel. In accordance with another aspect of the present invention, the intermediate roller comprises a vertically oriented spool roller having opposing ends of a first larger diameter for engaging the inner surface of the outer vessel and a smaller diameter medial portion that engages the outer surface of the inner vessel. The rotation between the smaller diameter medial portion and the larger diameter end portions characterizes how the inner vessel rotates.

The drive mechanism can include a rotor arm supported for rotation at the central axis of the outer vessel. The rotor arm has an end and a drive roller mounted on the end of the rotor arm for engaging the outer surface of the inner vessel and biasing the inner vessel against the intermediate roller. A central support can be positioned at the central axis of the inner vessel. A plurality of rotor arms can be mounted on the central support. Each rotor arm can have at each end a drive roller that engages a respective inner vessel. In yet another embodiment, drive roller can act initially to position the inner vessel against the intermediate roller. The intermediate roller can be driven around the outer vessel by suitable drive means. When the centrifugal force reaches a level that the inner vessel maintains contact with the intermediate roller, the positioning is no longer required.

In still another aspect of the present invention, the centrifugal finisher of the present invention can include at least one support member mounted for movement about the inner surface of the outer vessel on which the vertically oriented spool roller is rotatably mounted. An inner vessel support is mounted on the support member in a position radially inward toward the central axis of the outer vessel for rotatably supporting the inner vessel in which an object to be polished is inserted. The support member can also include a guide wheel for engaging and rolling along the outer surface of the outer vessel to aide in stabilizing the support member as it moves along the surface of the outer vessel. Thus, when the drive mechanism exerts a biasing force against the inner vessel, it engages the spool roller, and the support member then is moved about the inner surface of the outer vessel.

The support member in the illustrated embodiment includes two intermediate rollers rotatably mounted on the support member. This provides two contact points. The inner surface of the outer vessel also can include guide channels, and the spool roller ends having the larger diameter can be configured for engaging the guide channels of the outer vessel.

BRIEF DESCRIPTION OF THE DRAWINGS

This invention and its mode of operation will be more clearly understood from the following detailed description when read with the appended drawings in which:

FIG. 32*a* is a section analysis of a line plot cutter surface after polishing in accordance with the present invention while

DETAILED DESCRIPTION OF THE INVENTION

Figure 1:
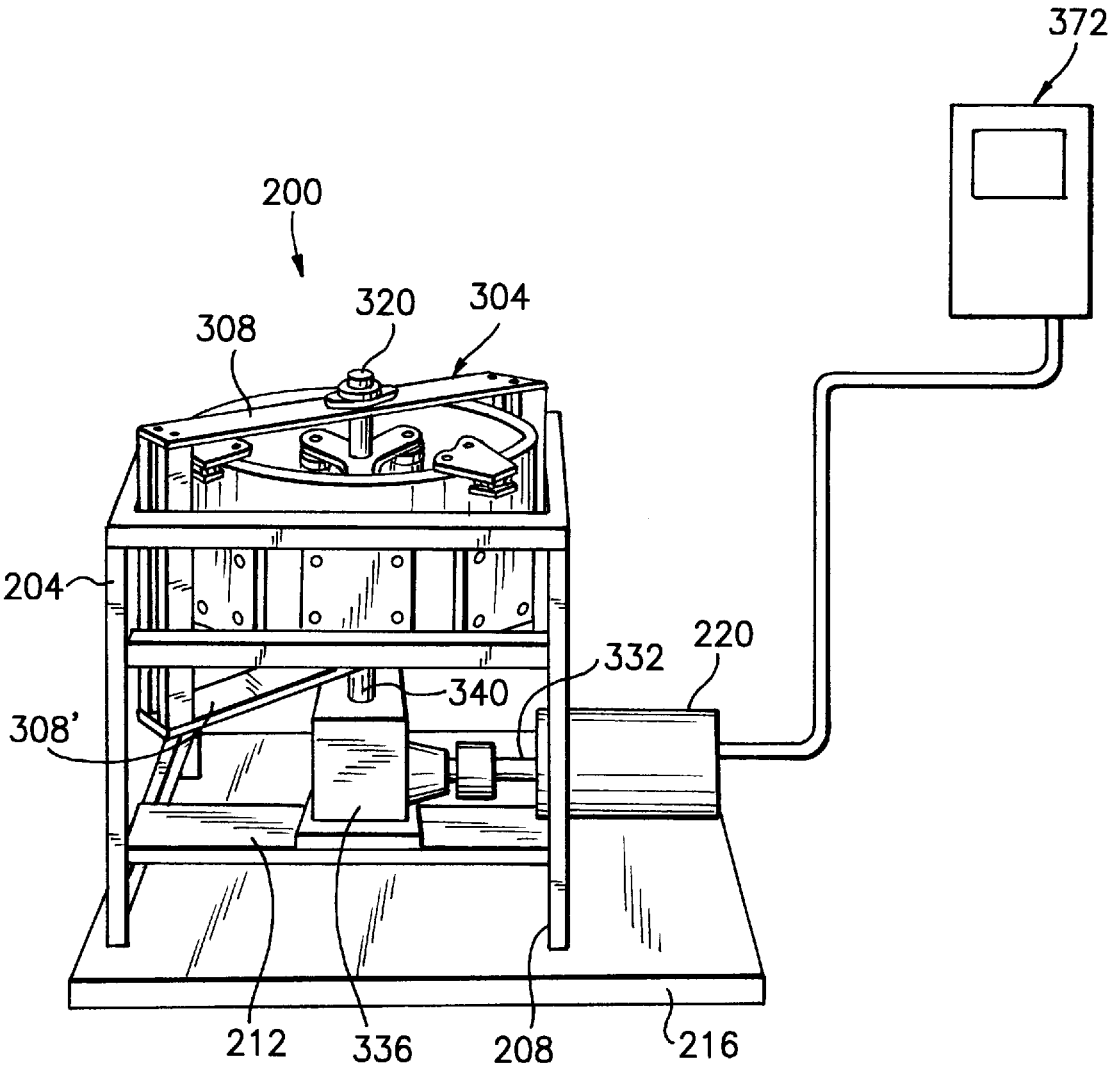
FIG. 1 is a general environmental view showing the centrifugal finisher according to the present invention connected to an external controller.
Figure 2:
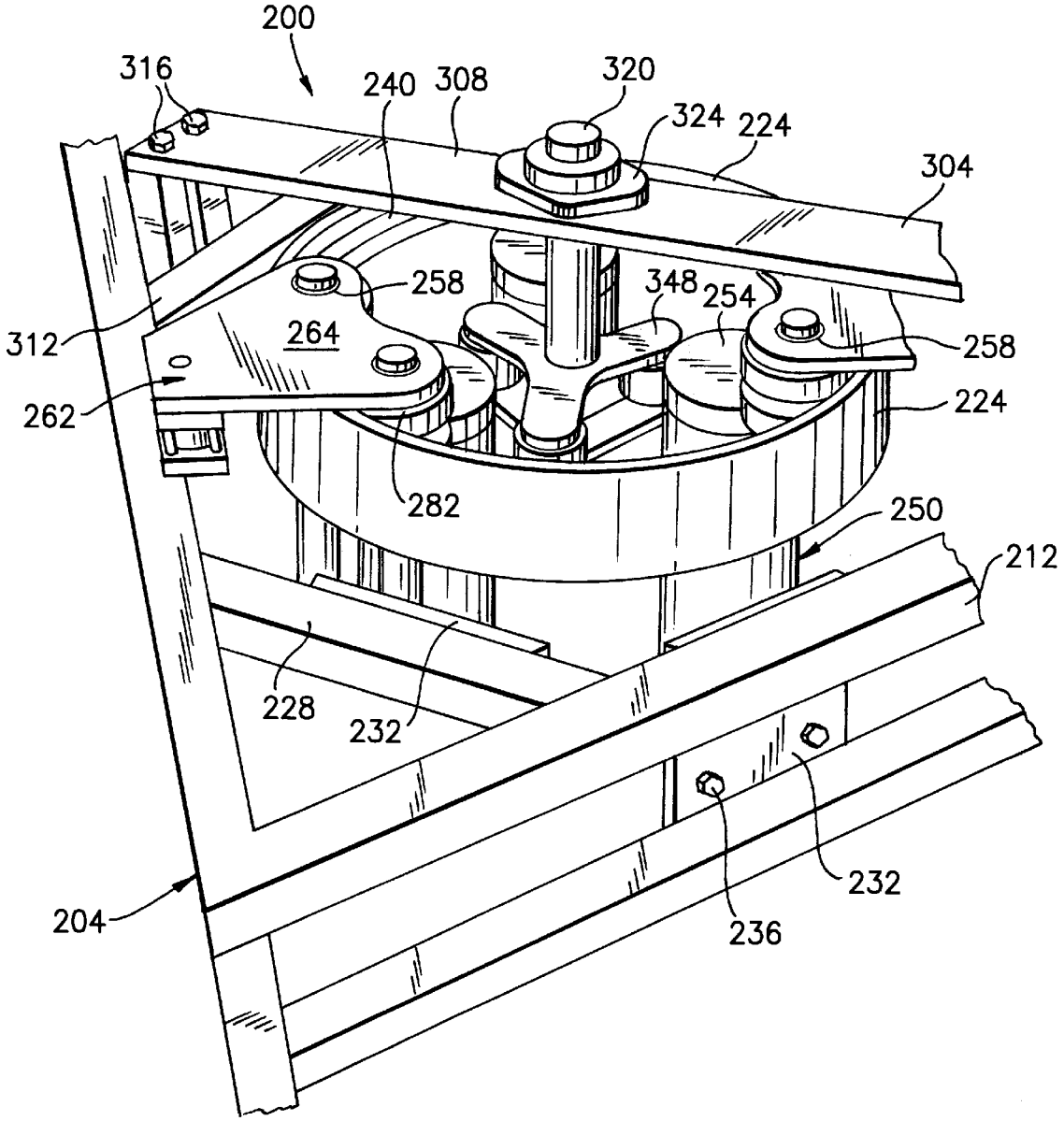
FIG. 2 is a close-up of the centrifugal finisher of FIG. 1 showing in greater detail some of the internal parts.

The present invention now allows the use of a centrifugal finisher or polisher that has an outer vessel that is fixed and nonrotatable. The present invention allows a much greater diameter outer vessel to be used and accordingly much larger objects can now be polished or finished. The outer vessel is fixed and nonrotatable and has an inner surface and a central axis. At least one inner vessel (in the illustrated embodiment three inner vessels) are positioned inside the outer vessel and contain at least an object to be finished. Each inner vessel has an outer surface. An intermediate roller (in the illustrated embodiment two intermediate rollers) are positioned between the inner surface of the outer vessel and the outer surface of each of the inner vessels and engages the surfaces of respective outer and inner vessels. A drive mechanism includes a rotor arm having a roller at its end, which biases the inner vessel against the intermediate rollers and forces the inner vessel around the central axis of the outer vessel. The rotation of the inner vessel is caused by its which is in engagement with the intermediate roller that rotates along the inner surface of the outer vessel.

The present invention now allows greater control over the finishing process and also allows larger objects to be polished. The final product after finishing is a superior product with enhanced properties. A listing of various objects that can be finished using the present invention can include but are not limited to:

nose cones on weapons to allow transmission of infra-red guidance signals; domes and windows; gem stones; orifices for air and liquid metering; nozzles for printing heads; pen tips; guide wires; windows for high temperature or corrosive environment; probes for measuring instruments; magnetic tapes; cleaning blades; pistons; ball check valves for precision metering pumps and dispensers; water jet cutting orifices and nozzles; fiber optic connectors; fiber optic lens; optical fiber slicing tips; gauge contact points; chemical and medical valves; stylus tips; apertures for particle counting; restrictors; torch tips; air bearings; aircraft instrumentation; medical implant devices; gyroscopes; laser optics—mirrors and lenses for guidance and focusing and crystals for laser generation; substrates for epitaxial deposition of semiconductor electronics; IR transmitting sensor windows used on aircrafts; quartz crystals in watches; telescopic mirrors.

The above-identified list is not inclusive of the varied and different objects that can be finished using the present invention.

Referring now to the drawings and more particularly to FIGS. 1 through 11, there is illustrated at 200 the centrifugal finisher of the present invention that finishes at least one object to high standards. The centrifugal finisher 200 includes a rectangular configured frame indicated generally at 204 having four support legs 208 and a number of supporting cross members 212. The support legs 208 and cross members 212 can be formed from extruded, rectangular configured stock made from aluminum, steel or other materials that exhibit strength and can resist stress. The frame is supported on a platform 216 that also supports the drive motor 220 used with the present invention.

As shown in FIGS. 2, 8, 9 and 10, the outer vessel 224 is supported within the rectangular configured frame 204 by opposing angle struts 228 and brackets 232 that are connected to the struts 228 and frame 204 by fasteners such as bolts 236, which are connected to the outer vessel 224. In the illustrated embodiment the outer vessel 224 is formed from a large cast piece or could be formed from other rigid material. Although the illustrated embodiment shows the outer vessel held within the rectangular configured frame 204, for much larger outer vessels used for polishing large objects, the outer vessel could be formed from concrete which could be placed in a large hole or rested on a large support surface. For very large objects to be finished such as jet turbine blades and other similar objects, the concrete could rest within a large hole for aesthetic purposes.

Figure 7:
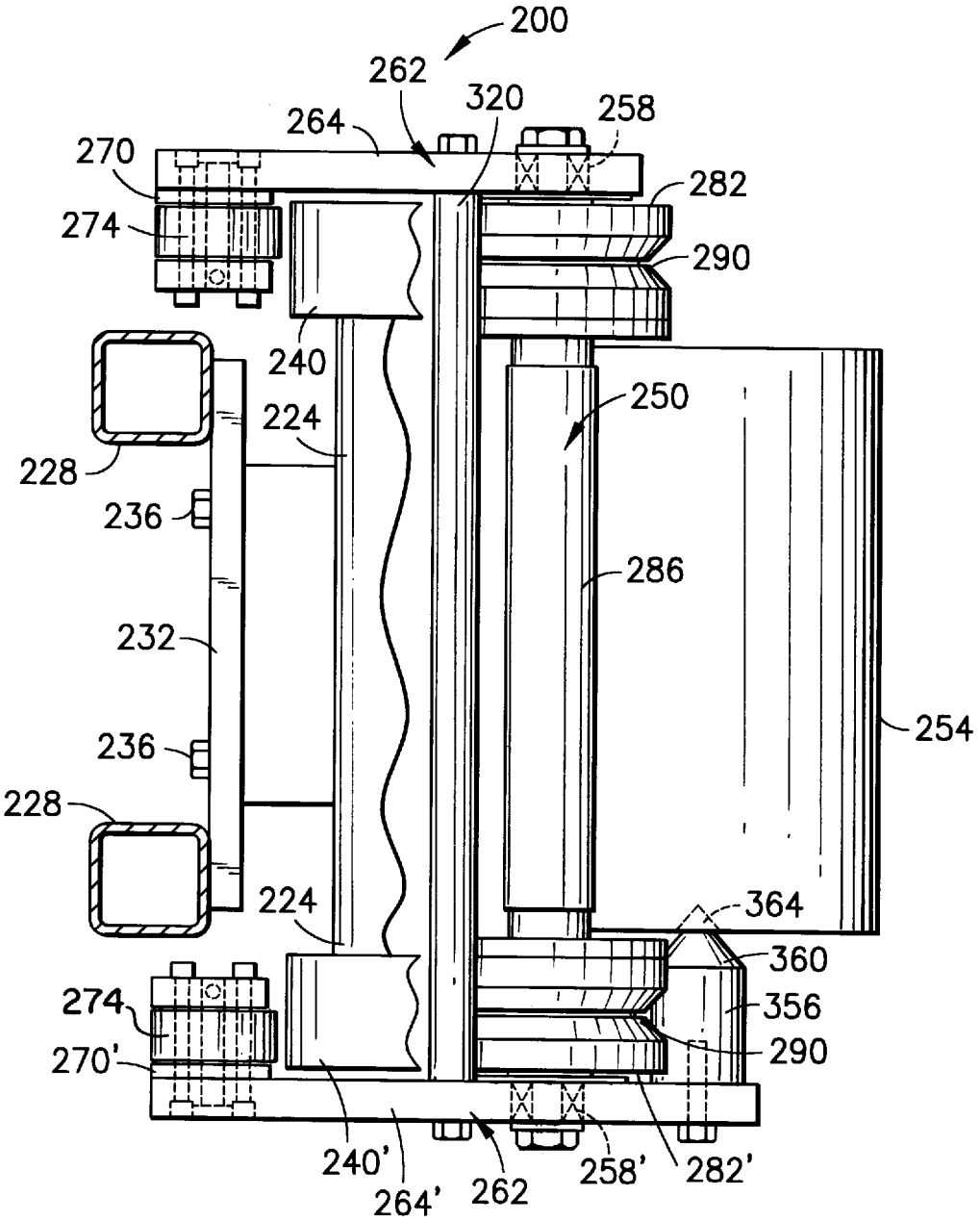
FIG. 7 is a side elevation view in partial section showing the support member that mounts the intermediate rollers.
Figure 11:
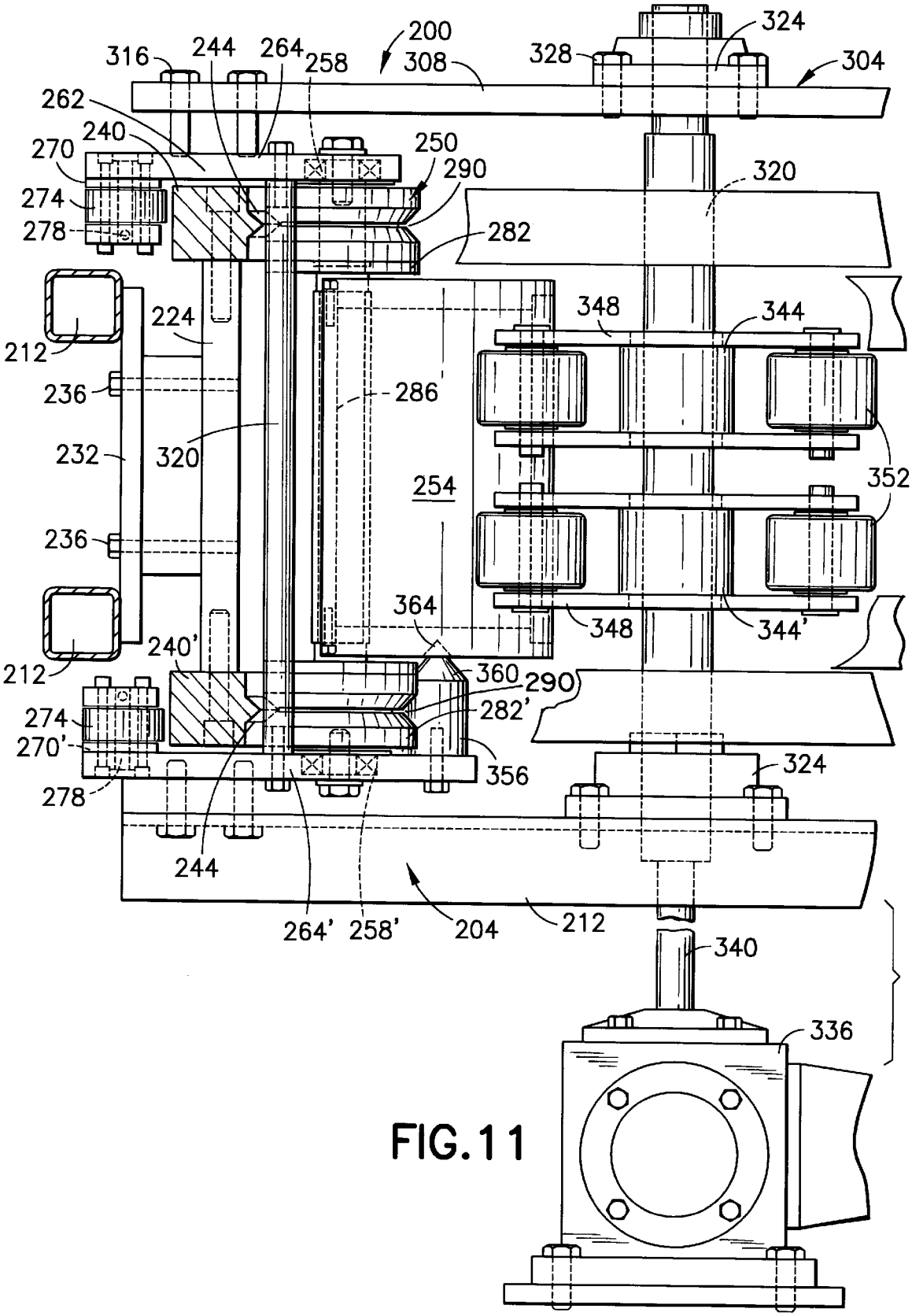
FIG. 11 is another side elevation view showing details of the support member, center drive shaft and related components.

As shown in greater detail in FIGS. 7 and 11, the outer vessel includes an upper and lower member 240, 240' each having a guide rail 244 which is used to guide the intermediate rollers 250 that engage the inner vessel 254, shaped similar to a barrel in which the objects to be polished are inserted. Each inner vessel 254 engages two intermediate rollers 250 that are supported by respective upper and lower bearing housings 258, 258' mounted on a support member 262 that is adapted to move along the inner surface of the outer vessel. The support member 262 includes an upper and lower roller support plate 264, 264' which mount the bearing housings 258, 258'. Wheel supports are mounted to the overhanging ends of the support plates 264, 264' and include a wheel 274 held by a bearing housing 278 so that the wheel is positioned on the outer surface of the outer vessel. This forms a structure similar to an overhead crane, but in a vertical orientation so that the entire support member 262 is supported on the outer vessel and can roll along the outer vessel.

As illustrated in FIG. 11 the intermediate roller includes two opposing ends 282, 282' having a greater diameter so that the medial portion 286 that engages the inner vessel 254 is of a reduced diameter. The opposing ends 282, 282' of the intermediate roller 250 include a guide groove 290 that engages the formed guide rail of the outer vessel. Thus, the entire structure of the support member 262 is held in place by the outer wheel 274 engaging the outer surface of the outer vessel 224 and the guide groove 290 positioned on the end portions 282, 282' of the intermediate roller engaging the guide rail that is positioned along the inner surface of the outer vessel.

Figure 3:
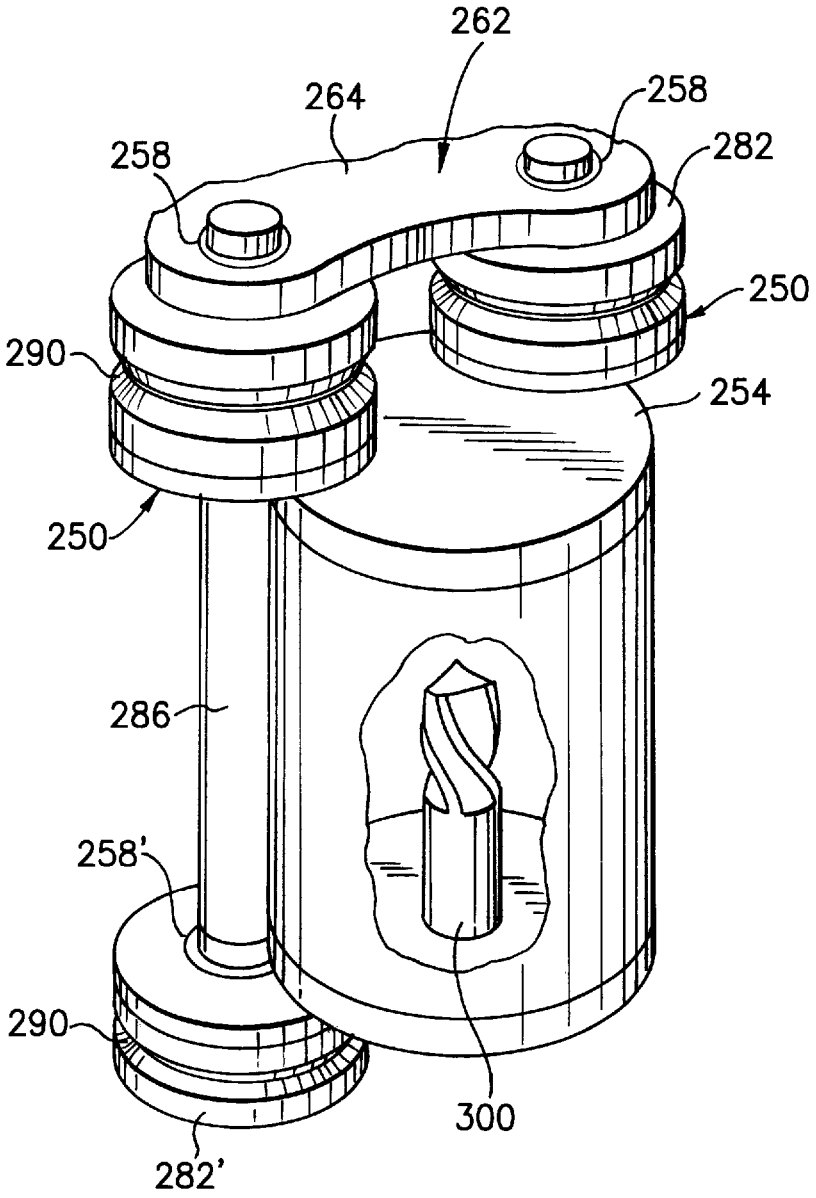
FIG. 3 is a schematic isometric view showing the inner vessel engaged with intermediate rollers.
Figure 4:
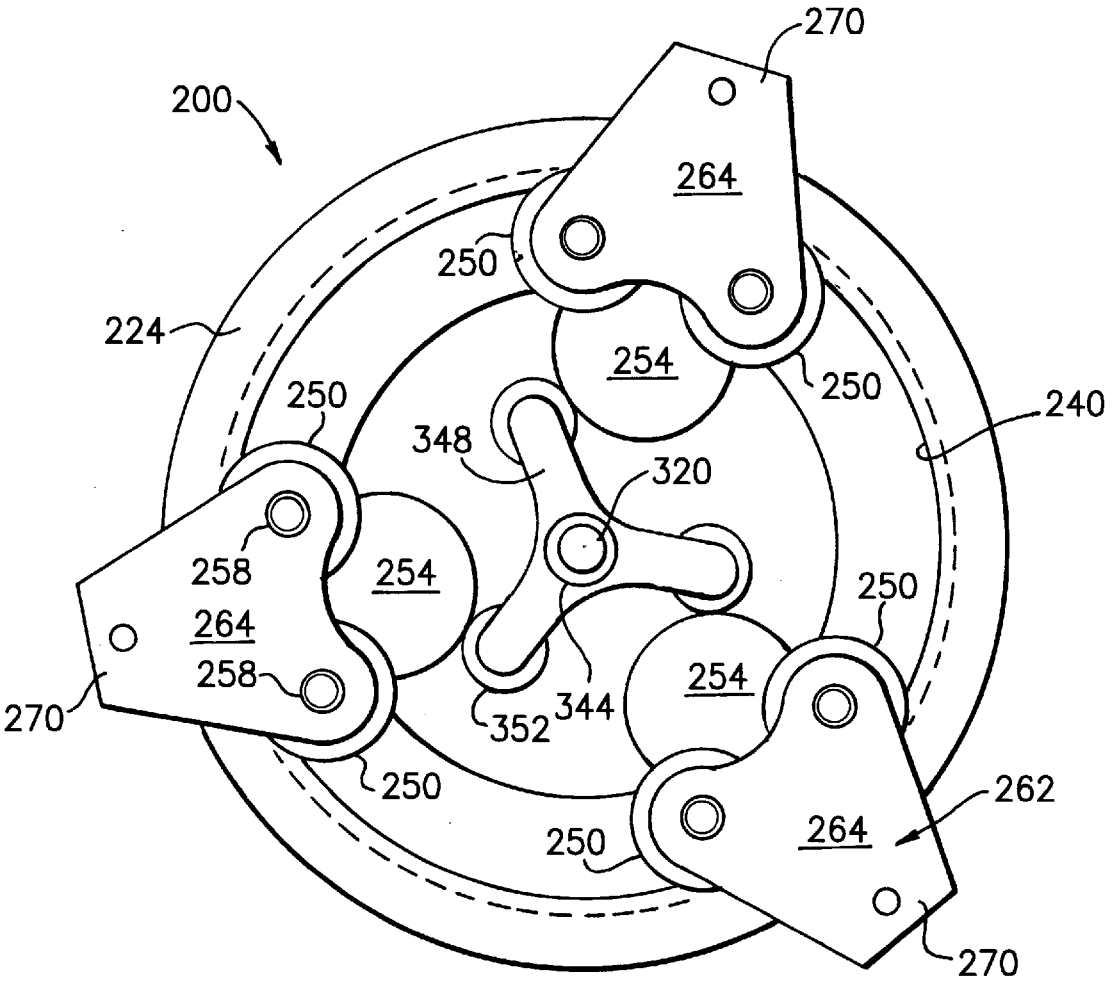
FIG. 4 is a schematic top plan view showing the outer vessel, inner vessels and support members and intermediate rollers.
Figure 5:
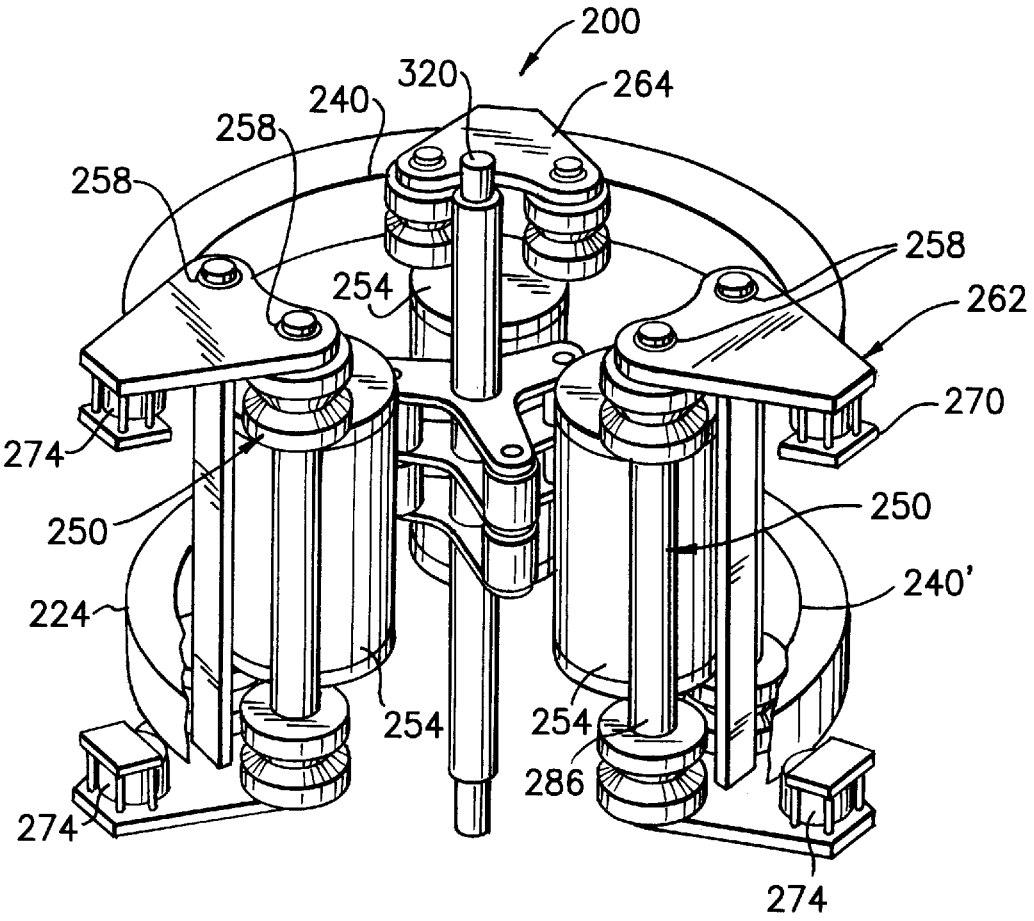
FIG. 5 is a schematic isometric view showing the relationship among the inner vessel, intermediate rollers, drive mechanism and outer vessel.
Figure 6:
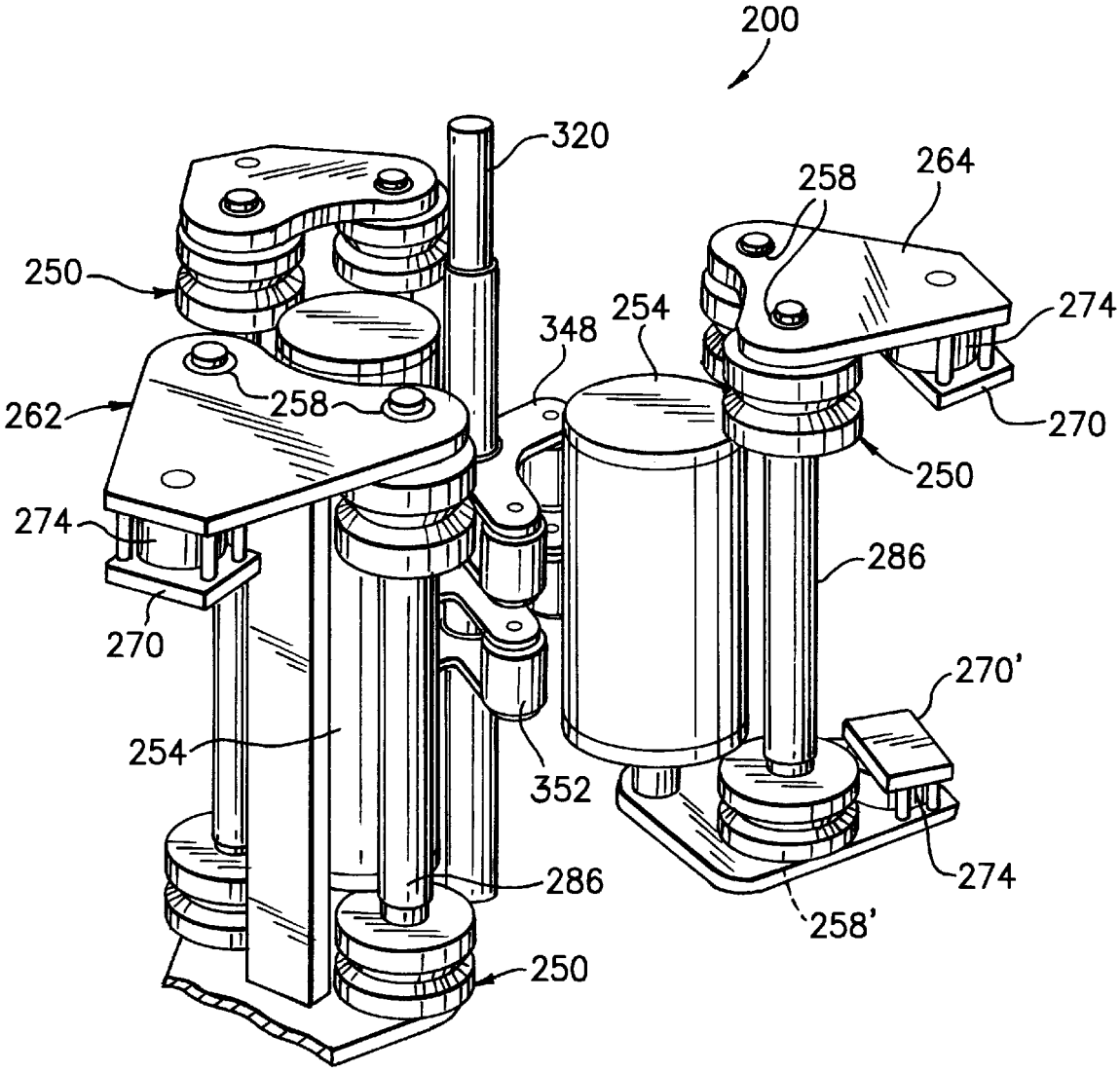
FIG. 6 is another schematic isometric view showing the relationship among the inner vessel, intermediate rollers, and drive mechanism.

FIG. 3 illustrates the relationship between the two intermediate rollers 250 and the inner vessel 254. The intermediate rollers 250 are held on the respective upper and lower bearing housings 258, 258' and the inner vessel 254 has an outer surface that engages the small diameter medial portion 286 of each intermediate rollers. In FIG. 3, a milling cutter 300 is held within the inner vessel 254, which typically also contains an abrasive media such compressed felt chunks having a particulate abrasive coating material such as described in U.S. Pat. No. 5,140,783, having a common inventor, and which is incorporated herein by reference in its entirety. FIG. 7 shows the relationship between the medial portion of the intermediate roller and the inner vessel.

Figure 8:
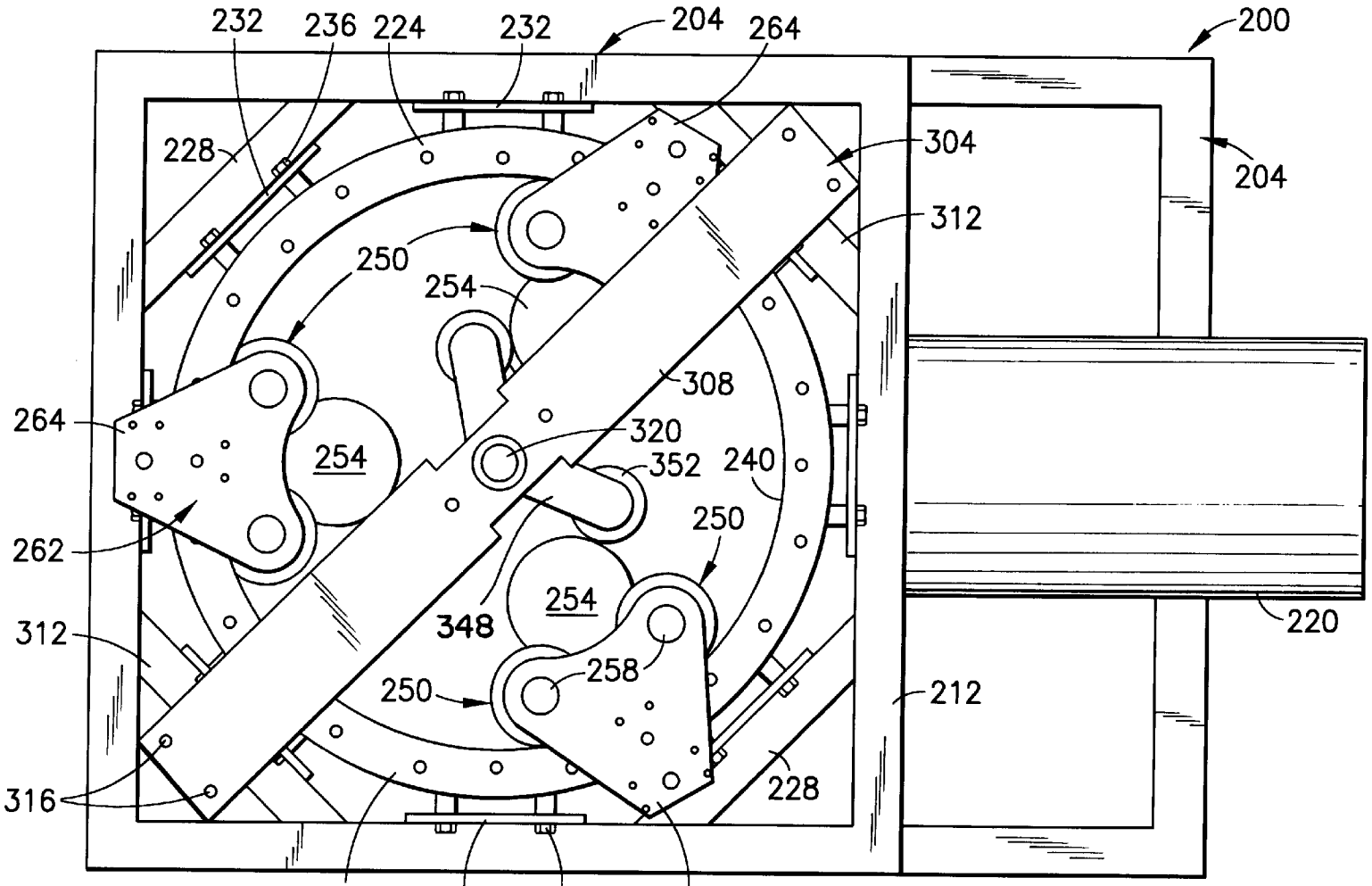
FIG. 8 is a top plan view of the centrifugal finisher of the present invention.
Figure 9:
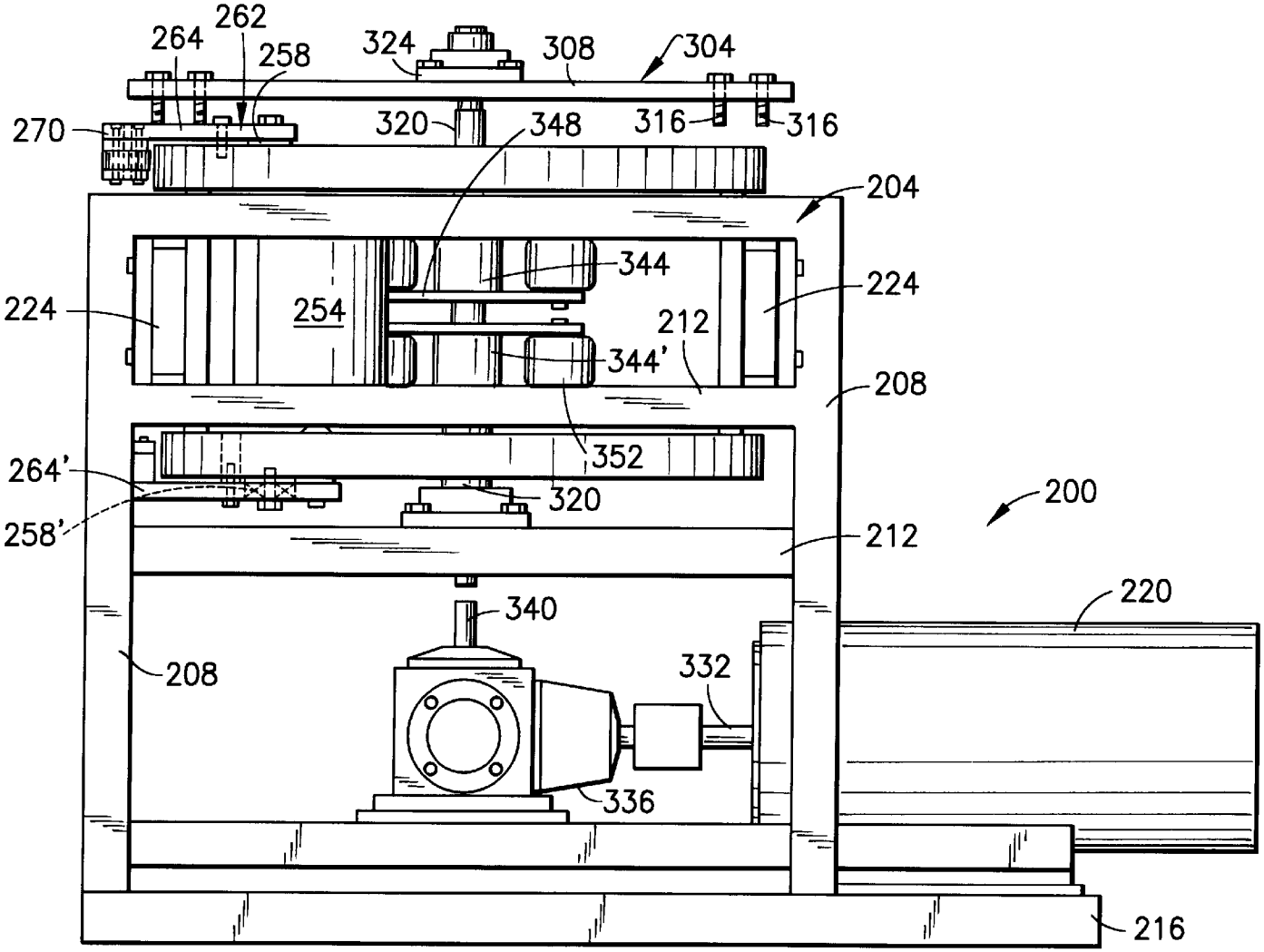
FIG. 9 is a side elevation view of the centrifugal finisher of the present invention.
Figure 10:
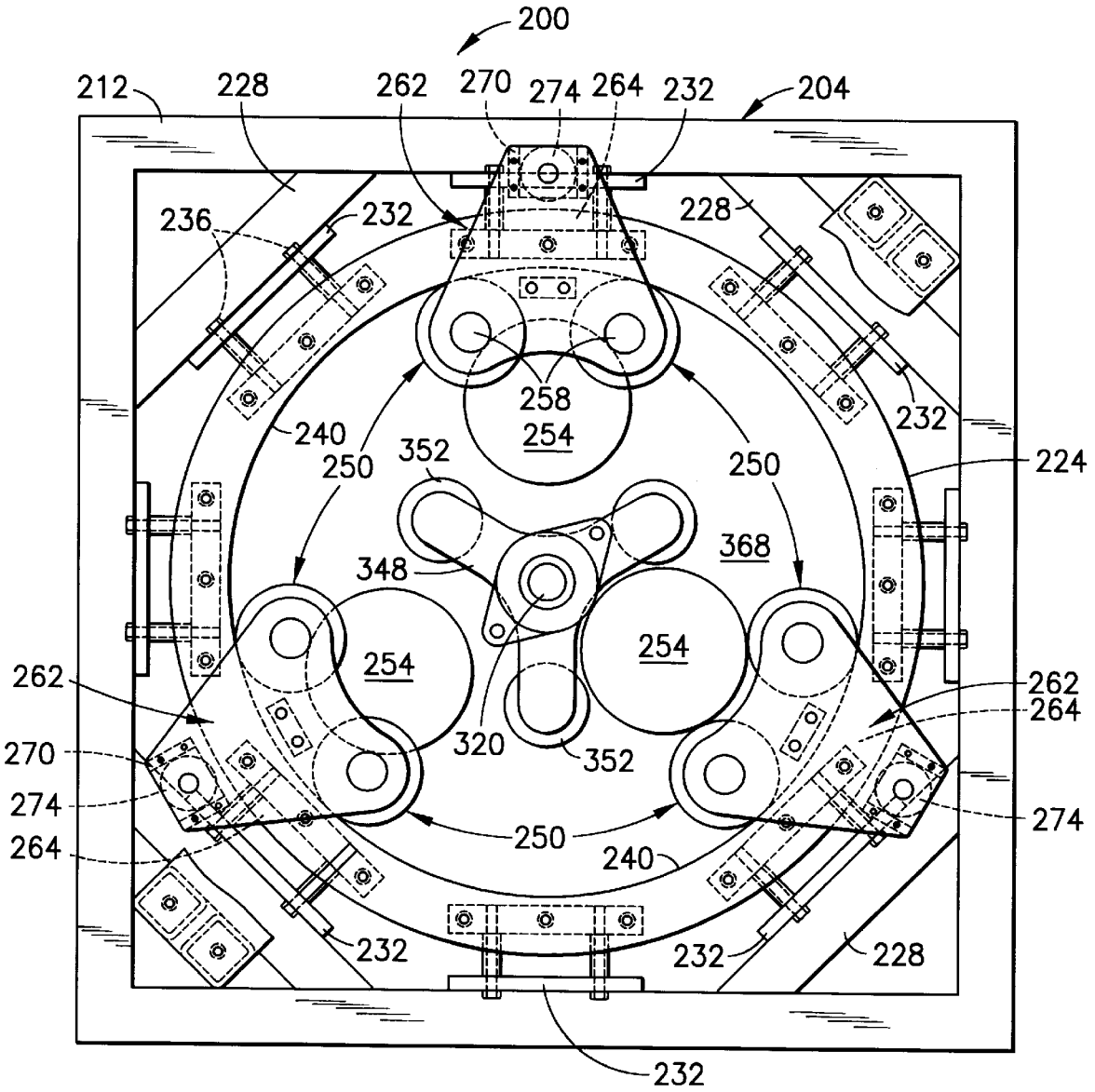
FIG. 10 is a top plan view of the centrifugal finisher of the present invention with parts broken away to show details about the drive mechanism, the inner vessel, the outer vessel and the intermediate rollers.

As shown in FIGS. 1, 8, and 9, a diagonally extending drive support 304 extends diagonally across the rectangular configured frame 204 and includes diagonally extending upper and lower support members 308, 308'. Support members 308, 308' are fixed by diagonal cross pieces 312 and appropriate fasteners 316 such as bolts. As best shown in FIG. 11, a central drive shaft 320 extends vertically along the central axis defined by the outer vessel from the lower diagonal support 308 to the upper diagonal support 308 and is supported on a bearing housing 324 fixed by fasteners 328 to the diagonal support members. The drive motor 220 has an output shaft 332 that connects into a gear drive 336 that in turn has an output shaft 340 that connects to the vertical drive shaft 320. The drive shaft 320 has a medial portion that includes upper and lower rotor arm supports 344, 344'. Each rotor arm support has three rotor arms 348 extending outward from the rotor arm support, forming an iscoseles triangle configuration as shown in FIG. 10. Each end of the rotor arm 348 includes a drive roller 352. As shown in FIGS. 8 and 10, the rotor arms 348 and drive rollers 352 are biased against respective inner vessel 254 (FIGS. 6 and 8) and through rotation of the central drive shaft 320 moves and rotates 254 the inner vessel against the intermediate rollers so that the intermediate rollers rotate and move along the inside surface of the outer vessel while the inner vessel rotates against the medial portion of the intermediate rollers.

For some very large outer vessels used for finishing very large objects, it may be desirable to drive the intermediate rollers by driving the support members instead of by the rotor arm. The rotor arm and drive wheel can be used for initially holding and positioning the inner vessels against the intermediate rollers when enough speed and resultant centrifugal force have been achieved. The inner vessels remain against the intermediate rollers without the need of the positioning aid, i.e., the rotor arm.

Each inner vessel is rotatably supported on the support member 262 resting on an inner vessel support 356 that is formed as a cone 360 with a blunt point for receiving a notch 364 located the flat bottom surface of the inner vessel. It is evident that the inner vessel can be easily removed from the support member 262 and reinserted. The two intermediate rollers 250 and the drive roller 352 form a support cradle 368 in which the inner vessel can be inserted onto the inner vessel support 356. The drive roller 352 biases the inner vessel 254 against the intermediate rollers 250, which engage the inner surface of the outer vessel. It is evident that the ratio between the enlarged end portions of the intermediate rollers and their medial portions as well as the diameter of the inner vessel controls the rotation of the inner vessel.

In operation, an operator works a digital computer as shown at 372 in FIG. 1, which controls the drive motor 220 and drive shaft rotation. Depending on the object to be finished, the drive shaft 320 rotates a predetermined number of revolutions per minute (RPM). The shaft 320 causes the drive roller to engage the inner vessel which is pushed against the medial portion of the intermediate roller so that the intermediate rollers rotate and move along the inner surface of the outer vessel and, in turn, rotate the inner vessel. The object then is polished. A traction surface is not necessary as noted in the incorporated by reference '638 patent and much greater control can be exerted over the finishing process to obtain much better results as well as any desired surface hardening characteristics without damaging the object to be finished.

FIGS. 12 through 34 show various test results using unpolished and polished materials. Some of the polished materials were finished using a colloidal and other prior art techniques. The tests prior art and are compared with results obtained with the apparatus and method of the present invention. FIGS. 12 through 19 show various results obtained with measurements on sapphire (ceramics) and more particularly the testing of sapphire optical lenses of missile cones (one of the most important components of a missile). The test results were conducted by Materials Modification, Inc. (MMI), a U.S. Federal Government (Department of Defense, NASA, Department of Commerce and the National Science Foundation) funded testing institute. MMI extensively tested the sapphire optical lens of missile cones and the process used in accordance with present invention represented on improvement. For example, the customary time to polish a sapphire optical lens of a missile cone was reduced for one piece from twenty hours manual skilled labor to twenty pieces per twenty hours with superior results on a fully automated basis. A high level of skilled labor is required to transform a machine condition sapphire to optical clarity (same classification as a contact lens). The method and apparatus of the present invention now allows increased optical clarity and increased strength in the optical lens of missile cones. The high quality of finishing in accordance with the present invention removes any minute deformities which prevents fracturing thereby increasing overall strength.

Figure 12A:
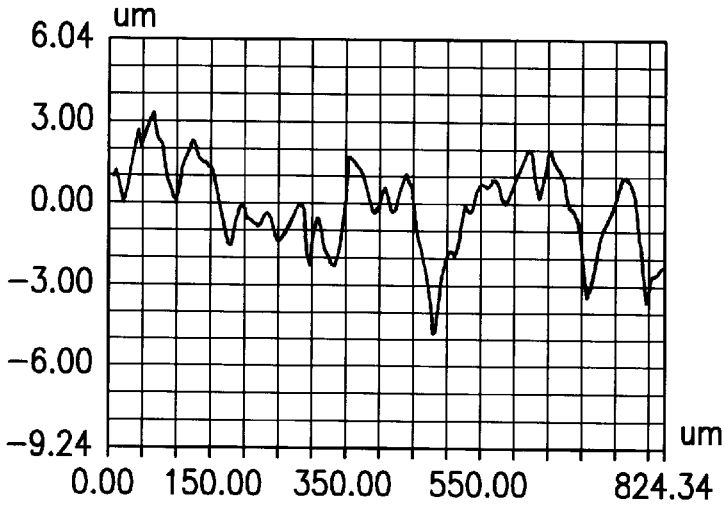
FIGS. 12*a* through 12*c* show profilometer scans of unpolished and polished nose cone pieces using a silicone carbide solution and colloidal silica.
Figure 12B:
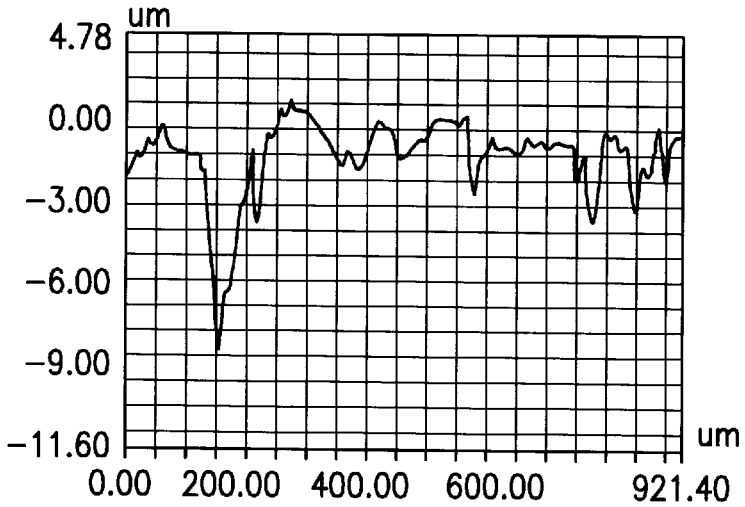
Figure 12C:
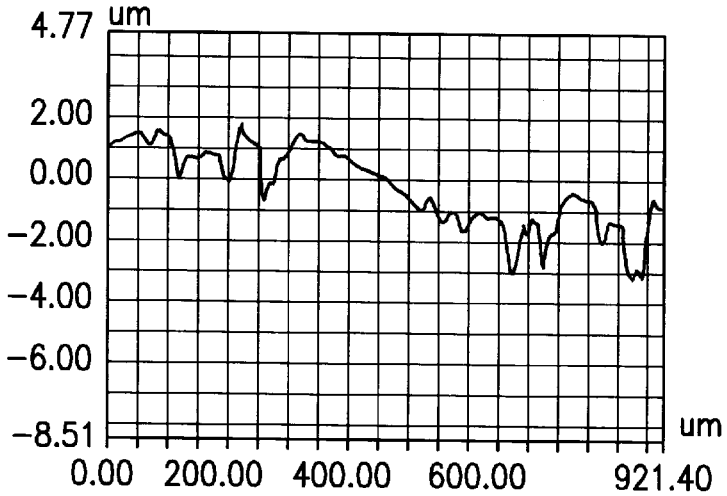

FIGS. 12*a* to 12*c* illustrate profilomitor scans of nose cone pieces. An unpolished piece is shown in FIG. 12*a*. A nose cone piece is polished for ten hours in a silicon carbide solution is shown in FIG. 12*b*. A nose cone piece is polished in colloidal silica for ten hours is shown in FIG. 12*c*.

Figure 13A:
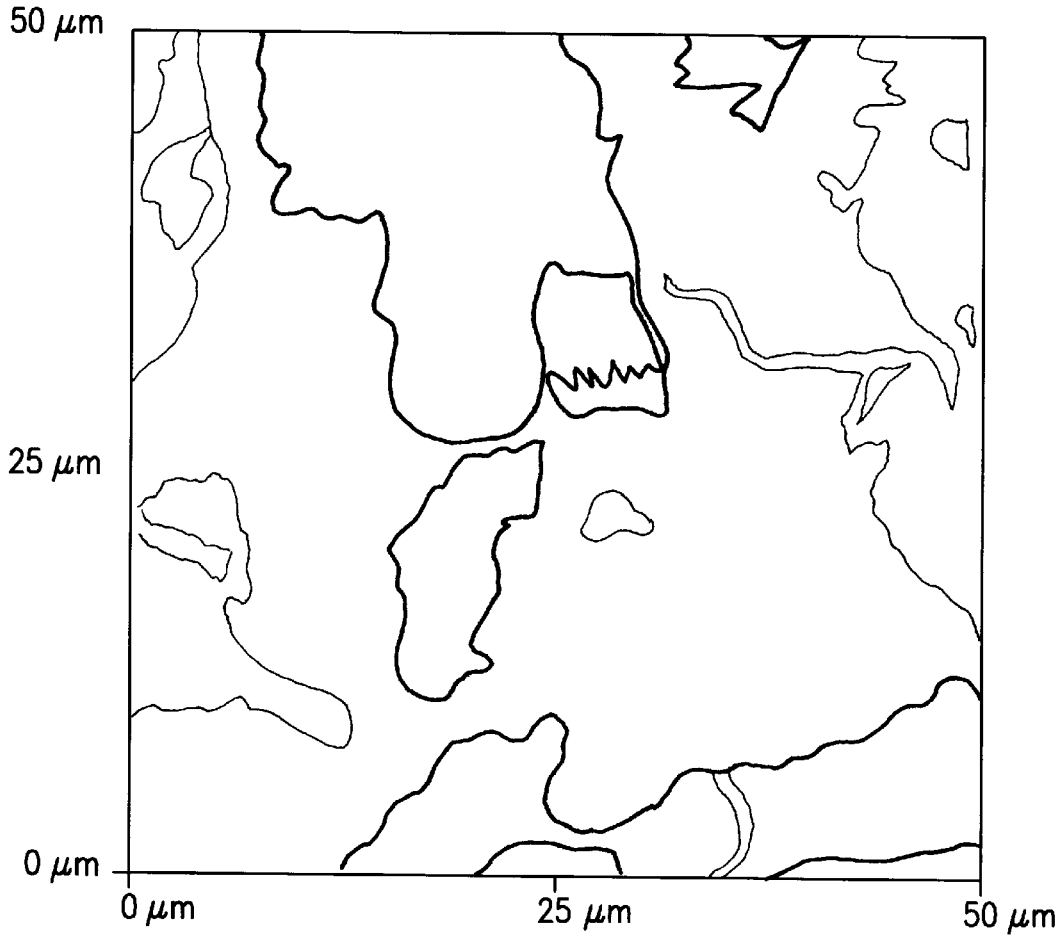
FIGS. 13*a* and 13*b* show an atomic force microscope image of an unpolished sapphire nose cone surface.
Figure 13B:
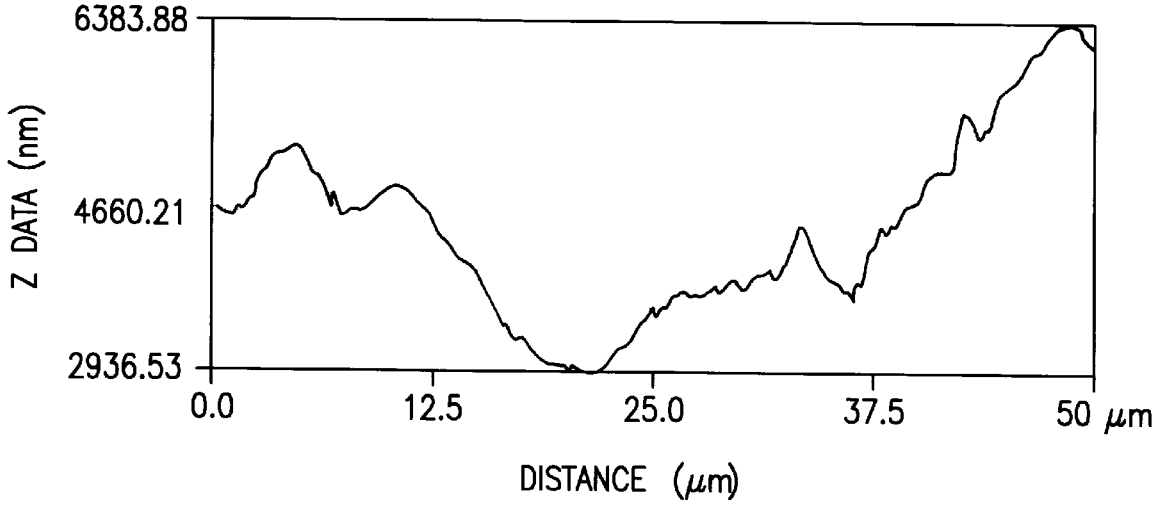

FIGS. 13*a* and 13*b* shows the topometrix atomic force microscope image of unpolished sapphire nose cone surface.

Figure 14A:
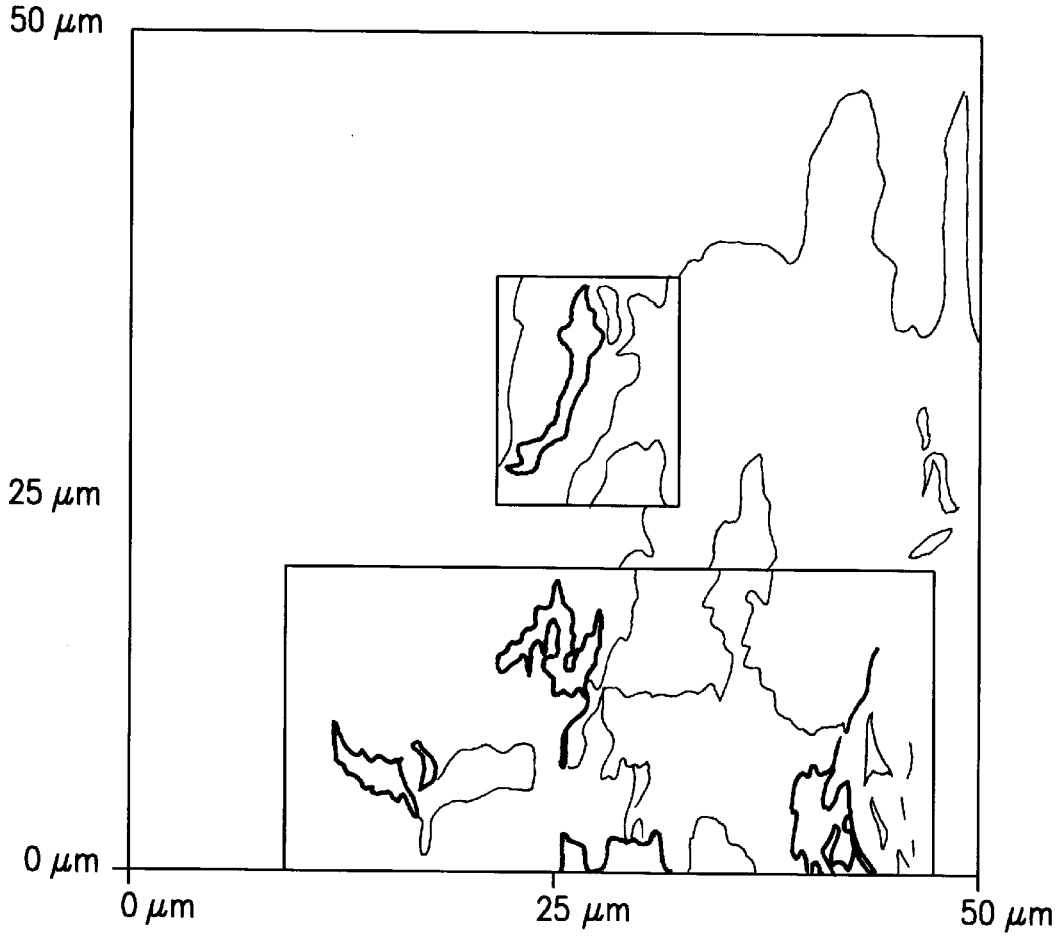
FIGS. 14*a* and 14*b* show an atomic force microscope image of a sapphire nose cone piece polished in colloidal silica.
Figure 14B:
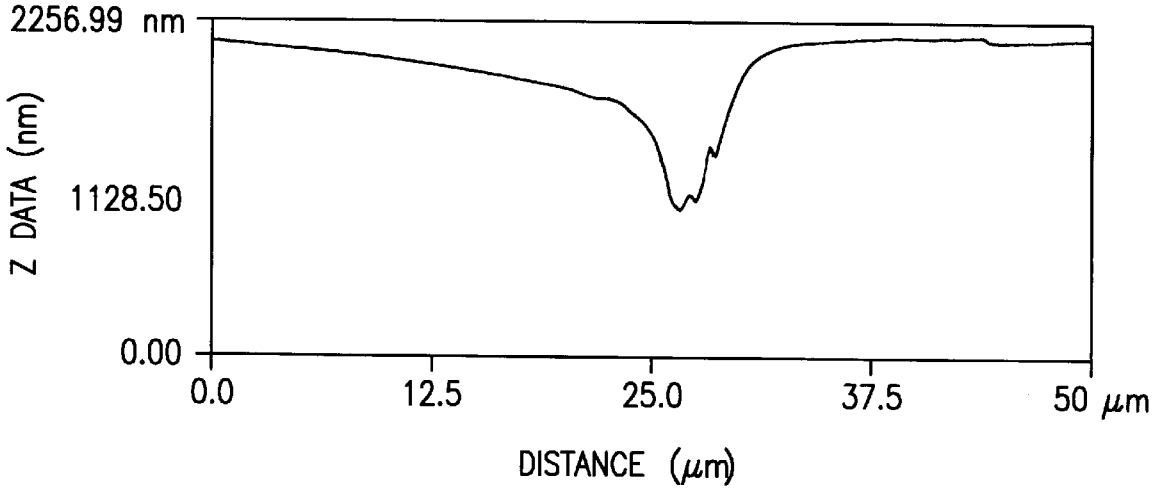

FIGS. 14*a* and 14*b* show a topometrix atomic force microscope image of a sapphire nose cone piece polished for thirty hours in a colloidal silica.

Figure 15A:
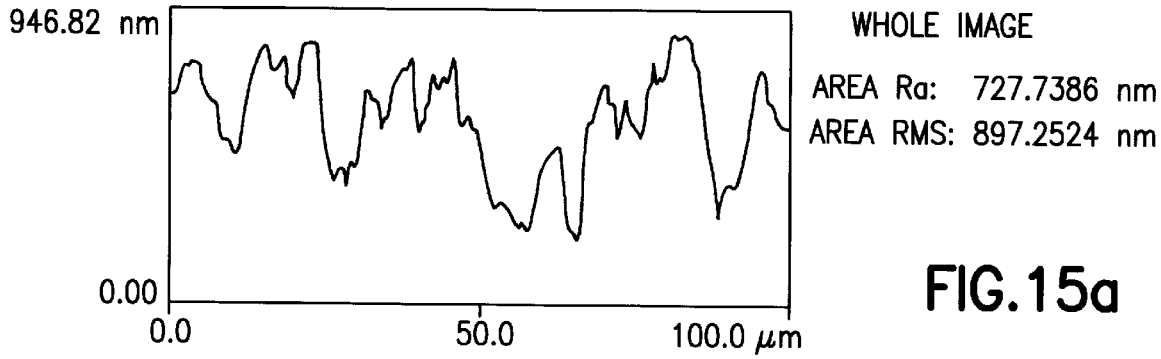
FIGS. 15*a* through 15*c* show an atomic force microscope two dimensional scan of unpolished sapphire and polished sapphire in colloidal silica.
Figure 15B:
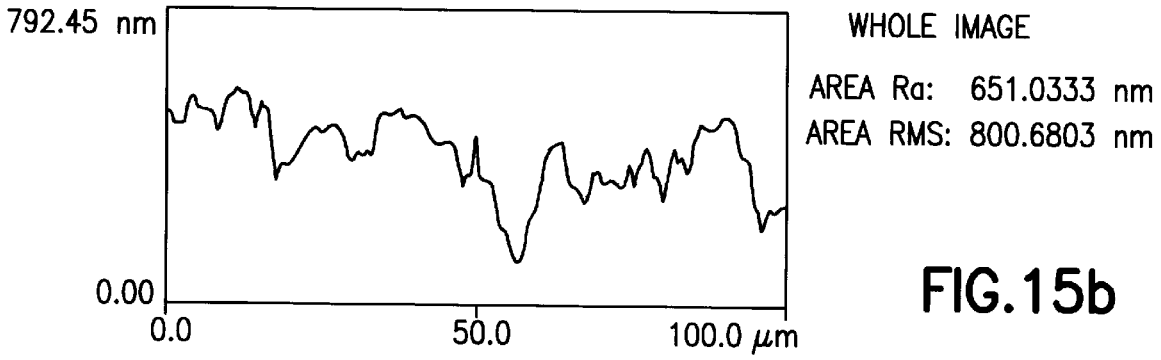
Figure 15C:
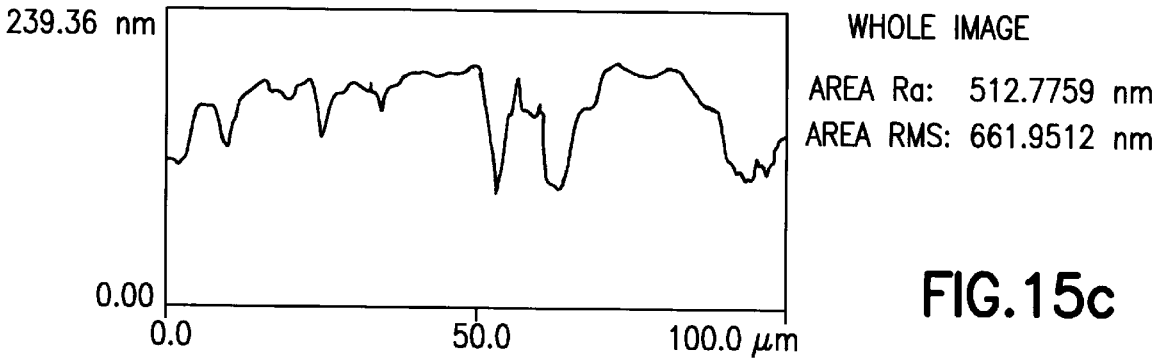

FIGS. 15*a* shows a topometrix atomic force microscope in two dimensional scans of unpolished sapphire disks. FIG. 15*b* is a polished sapphire disk polished for thirty hours in a colloidal silica. FIG. 15*c* shows a sapphire disk polished for sixty hours in colloidal silica. The vertical scale in the chart is progressively smaller for the scans of FIGS. 15*a* through 15*c* to bring out the smaller features as finish improved. The peak to valley distance has been reduced from 600 nm to 110 nm overall.

Figure 16A:
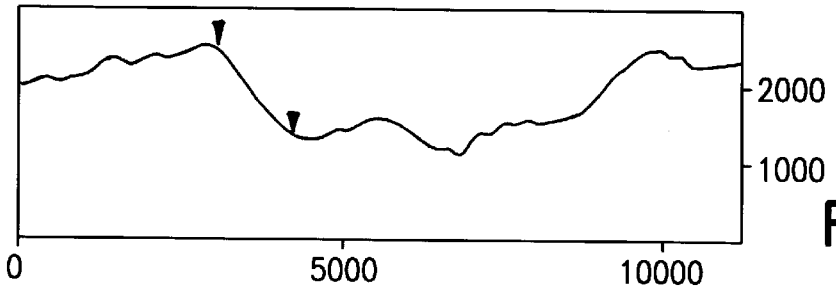
FIGS. 16*a* through 16*c* show digital instrument AFM images of unpolished arced surface and a surface that has been polished by the apparatus of the present invention, and another surface polished by another method.
Figure 16B:
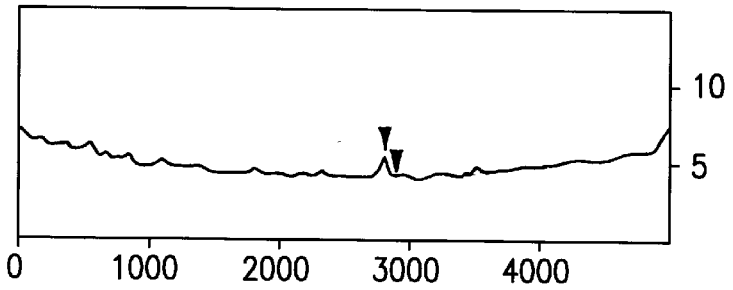
Figure 16C:
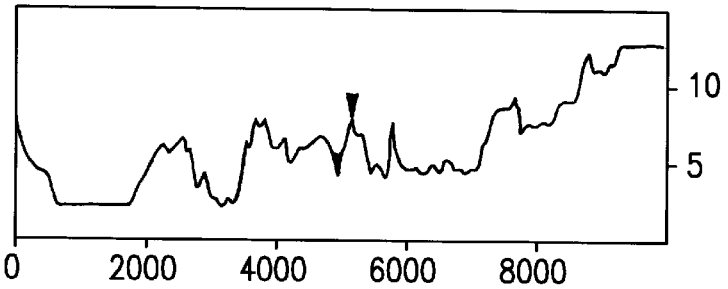

FIG. 16*a* illustrates a digital instrument AFM image of unpolished arced surface. FIG. 16*b* illustrates the surface that is polished for twenty-five hours in accordance with the present invention. FIG. 16*c* illustrates a piece polished to optical clarity by Insaco Corporation.

Figure 17A:
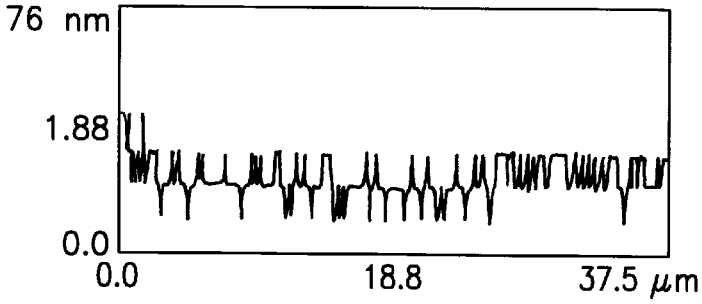
FIGS. 17*a* through 17*c* show atomic force line plots of a nose cone surface polished for fifty hours in colloidal silica.
Figure 17B:
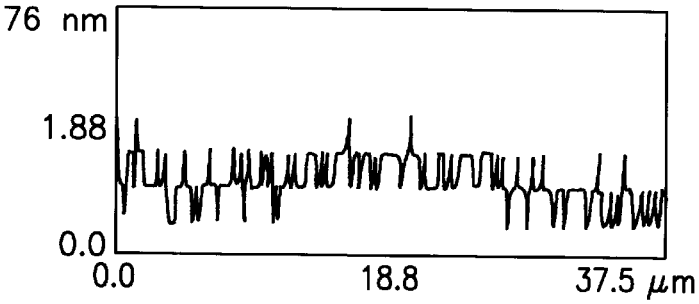
Figure 17C:
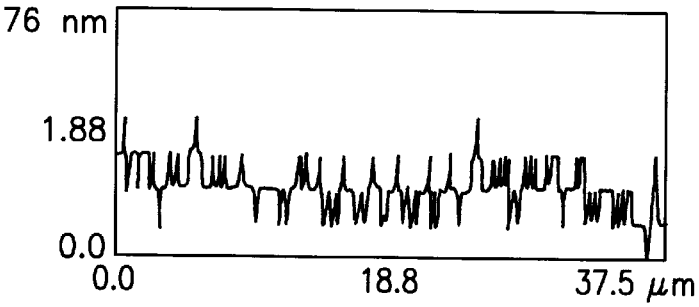

FIG. 17*a* through 17*c* illustrate a topometrix atomic force microscope line parts of nose cones surface polished for fifty hours in a colloidal silica.

Figure 18:
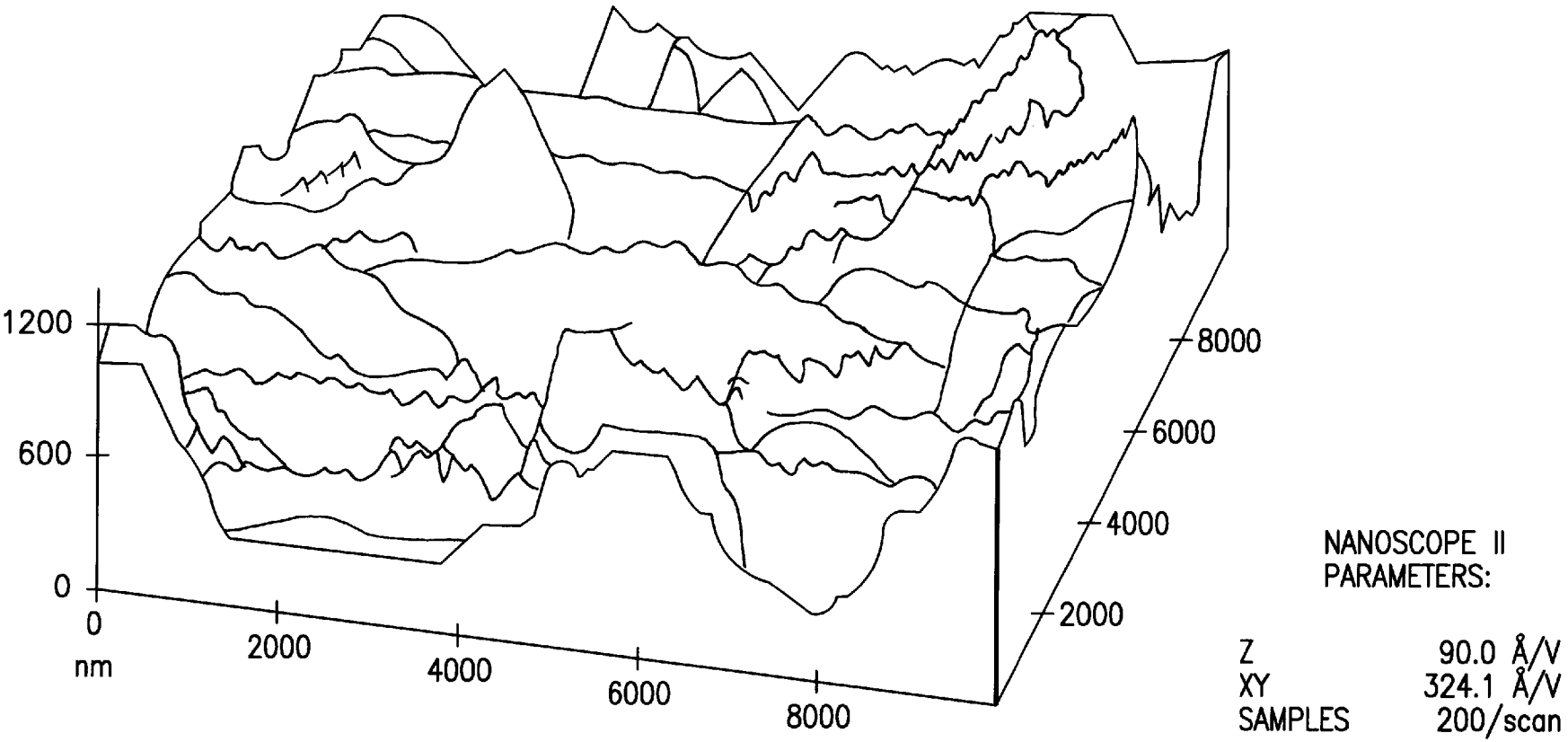
FIG. 18 shows a typical AFM of rough unpolished sapphire surface.

FIG. 18 illustrates a typical AFM of rough unpolished sapphire surface.

Figure 19:
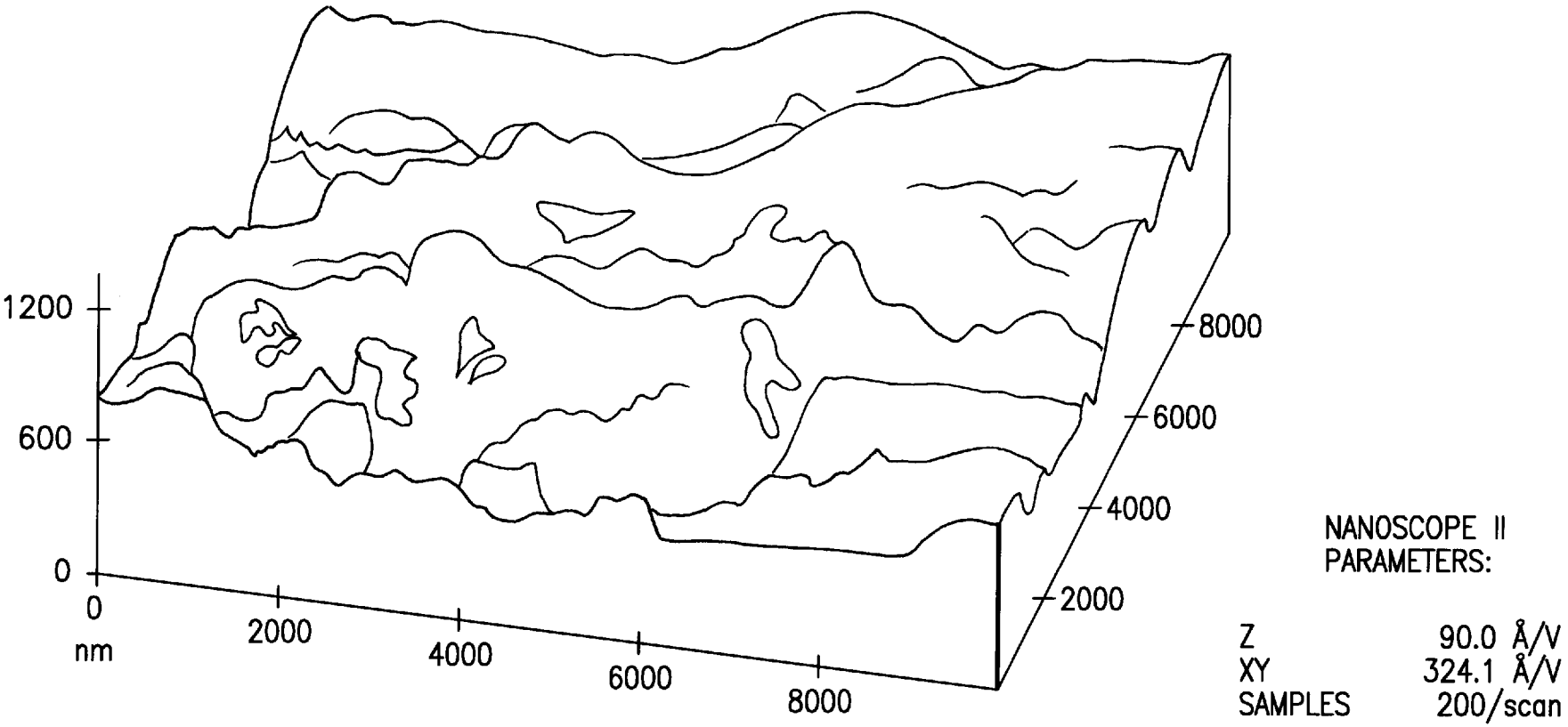
FIG. 19 shows a typical AFM scan of polished sapphire surface that has been polished using the present invention.

FIG. 19 shows a polished sapphire surface using the apparatus and method of the present invention.

FIGS. 20 through 34 represent the results on surface roughness values and measurements on drills.

Four measurements were done on each cutting tool, and on either side of the cutting edge and the average values are reported in the table below. The 3D and the surface profile plots in are representative i.e., two of the four measurements made per drill. The measurements were done using the Zygo New View 200 surface structure analyzer.

| | Surface Measurements in μm | | | | Line Measurement in μm | | | |
|---|---|---|---|---|---|---|---|---|
| | rms | Ra | rms | Ra | rms | Ra | rms | Ra |
| TiN coated new drill | 0.610 | 0.397 | 0.400 | 0.294 | 0.611 | 0.486 | 0.262 | 0.214 |
| H-Technology polished TiN coated new drill | 0.491 | 0.319 | 0.460 | 0.288 | 0.434 | 0.338 | 0.237 | 0.193 |
| TiN coated used drill | 1.406 | 1.050 | 1.008 | 0.559 | 1.623 | 1.302 | 0.850 | 0.665 |
| H-Technology polished TiN coated used drill | 1.067 | 0.712 | 0.506 | 0.425 | 0.528 | 0.423 | 0.485 | 0.496 |

Inferences

- The rms values are at least 40% lower, for the used H-Technology polished drill than TiN coated used drill without the H-Technology polish. This suggests that since the surface is smoother, the number of holes that can be cut with the H-Technology treated TiN tool will be higher than the TiN coated used drill.
- It can be presumed from this data that the quality of chips/swarf will be different in each tool. The smooth surface may produce a continuous swarf while the TiN coated surface without the H-Technology polish may produce small chips during cutting.
- It would have been interesting to measure the actual smoothness of holes cut using the drills. They are bound to be better and moire uniform in tolerance with the H-Technology coated drill versus the TiN coated drill.

Figure 20A:
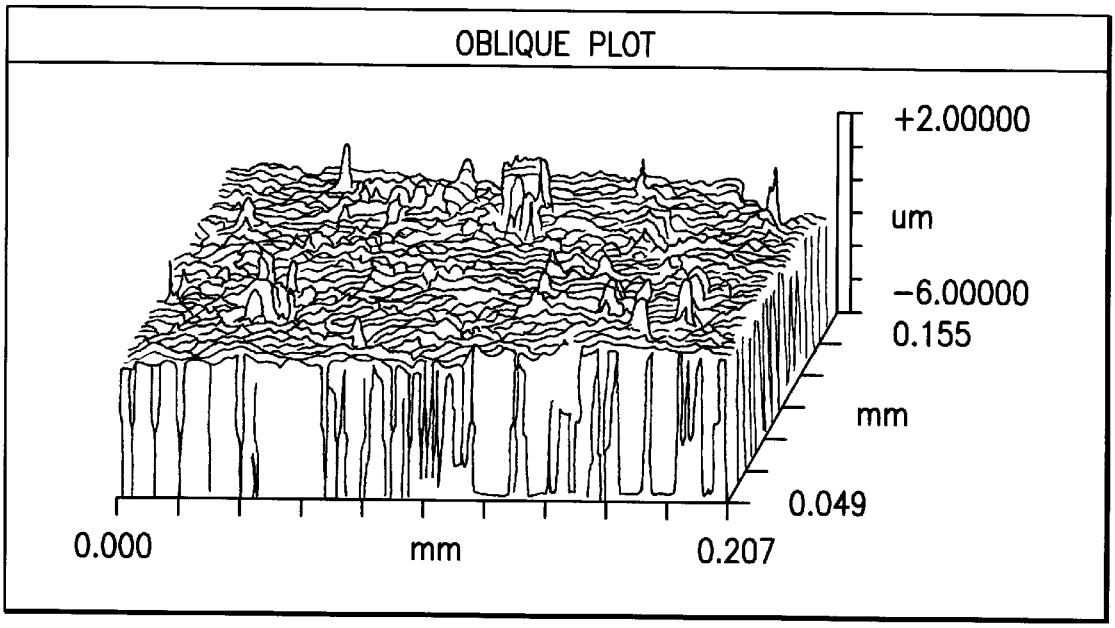
FIGS. 20*a* and 20*b* show a 3D profile of new drills before and after polishing in accordance with the present invention.
Figure 20B:
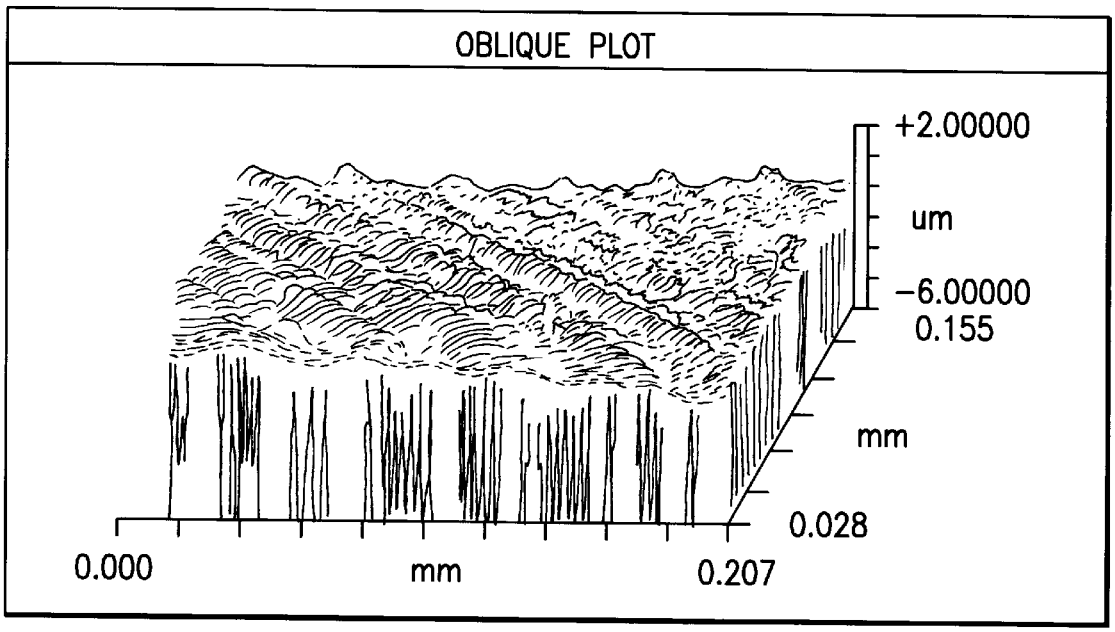

FIGS. 20*a* and 20*b* show a 3D profile of a new TiN coated drill both before and after polishing using the apparatus and method of the present invention.

Figure 21A:
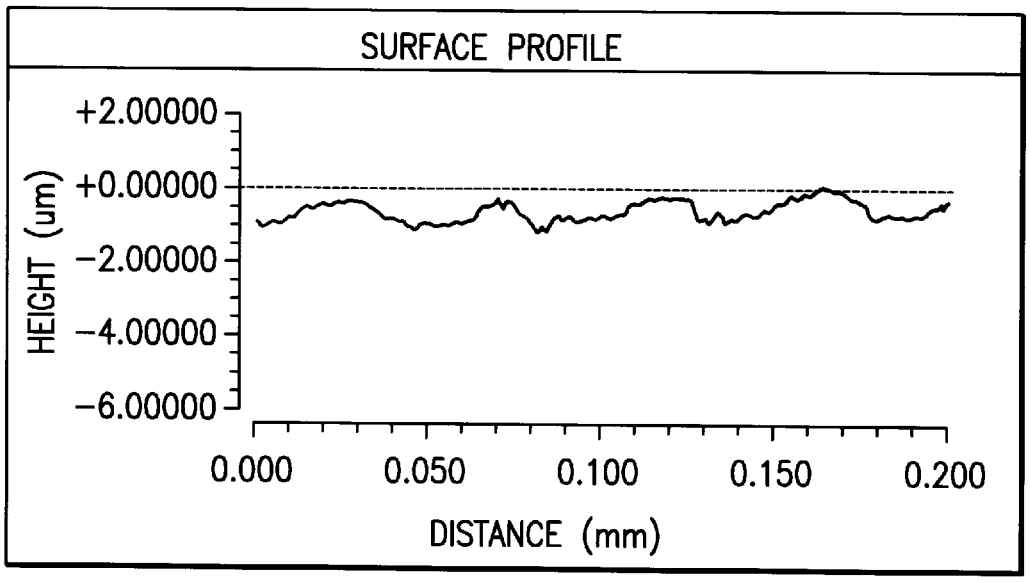
FIGS. 21*a* and 21*b* show a surface profile of new drills before and after polishing in accordance with the present invention.
Figure 21B:
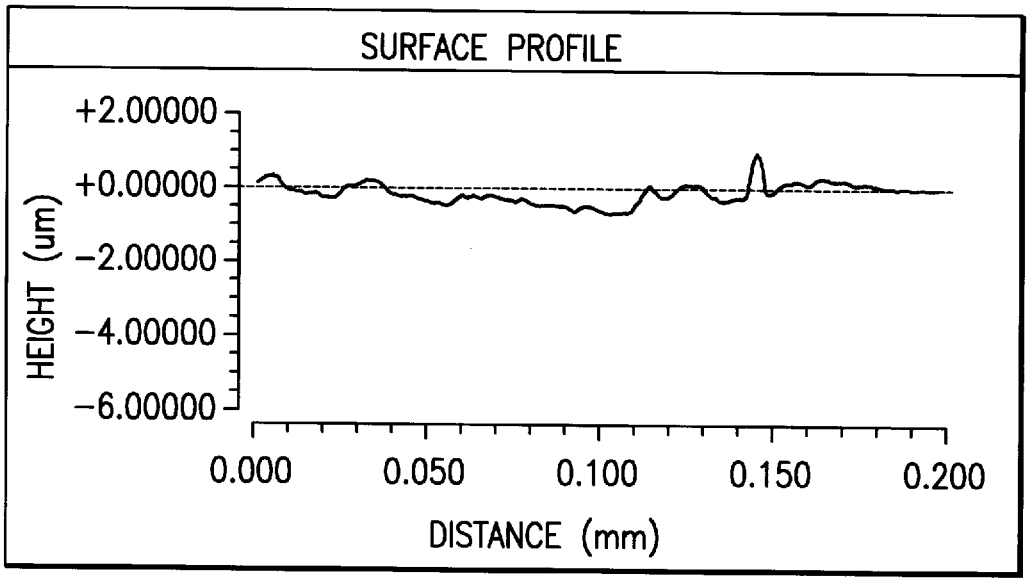

FIGS. 21*a* and 21*b* show the surface profile of a new drill, both before (FIG. 21*a*) and after (FIG. 21*b*) polishing.

Figure 22A:
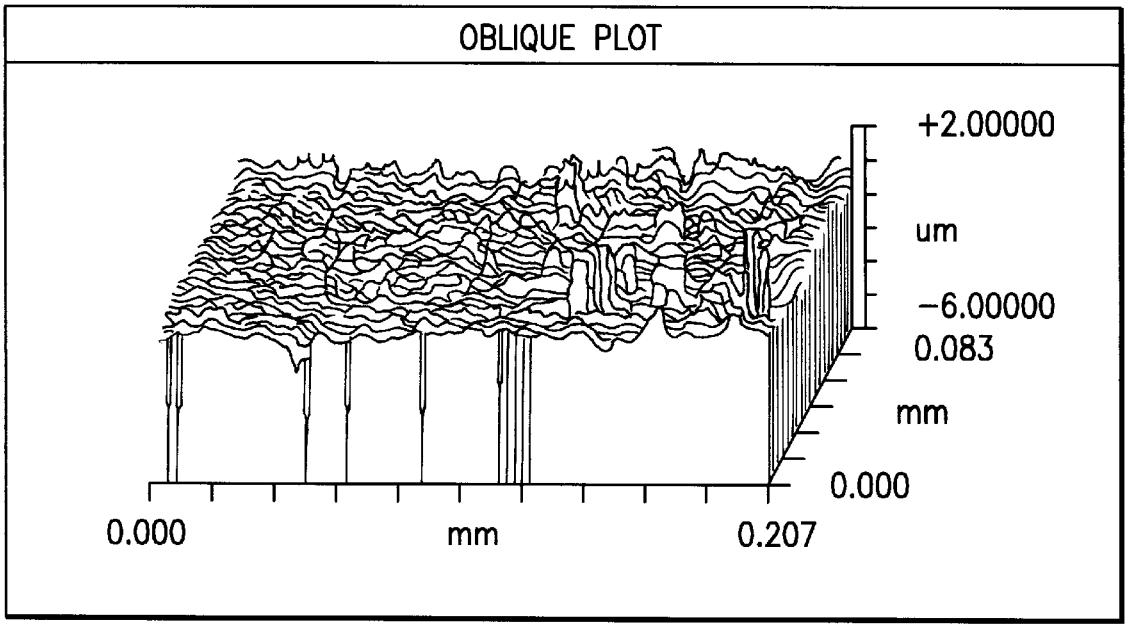
FIGS. 22*a* and 22*b* show a 3D profile of new drills before and after polishing in accordance with the present invention.
Figure 22B:
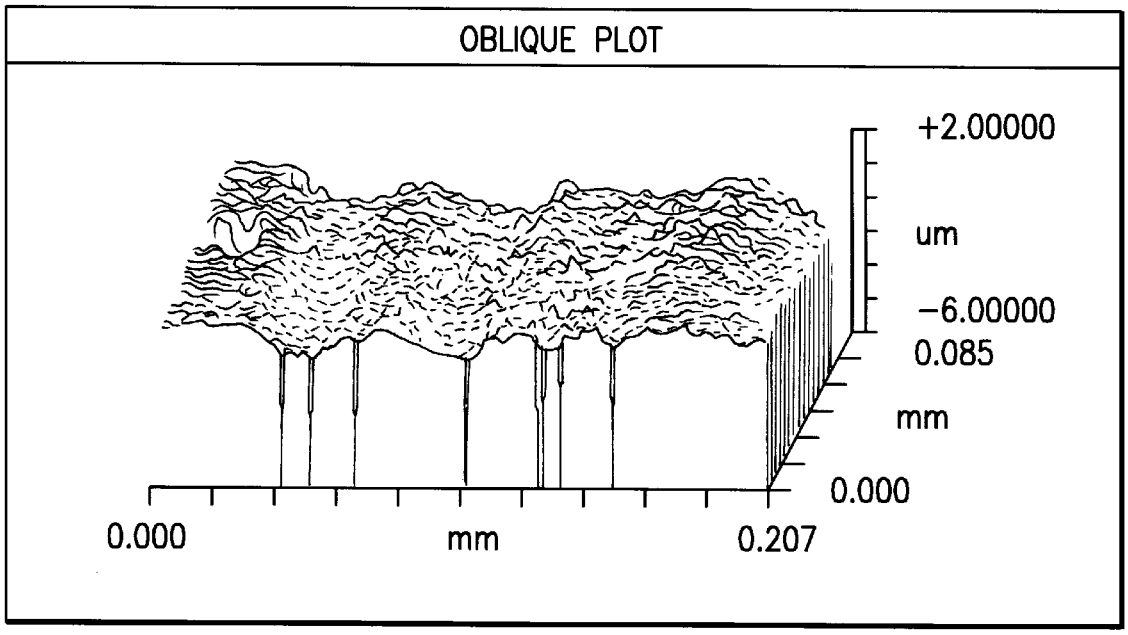

FIGS. 22*a* and 22*b* show the before and after polishing and show a 3D profile of new drills.

Figure 23A:
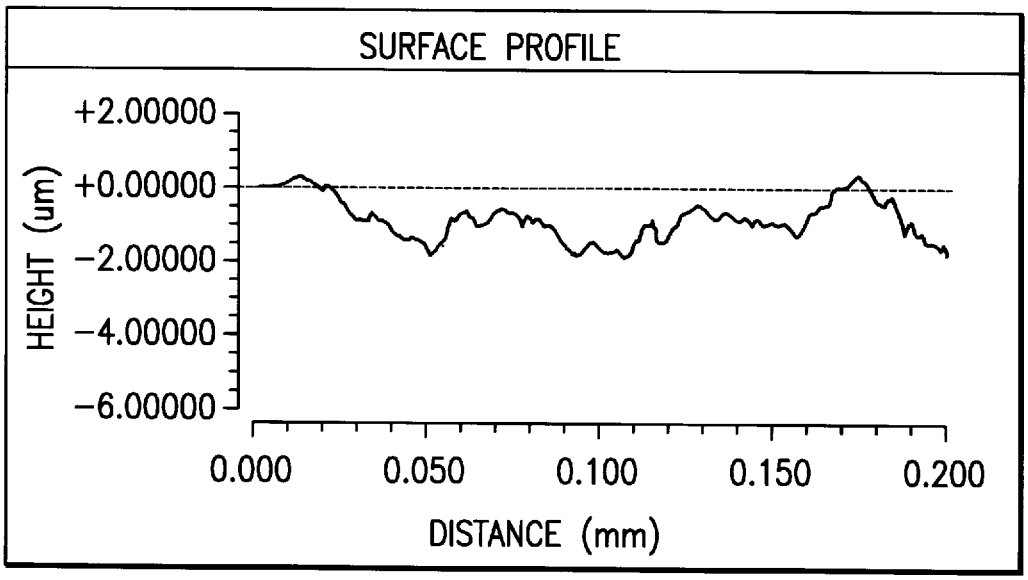
FIGS. 23*a* and 23*b* show a surface profile of new drills before and after polishing.
Figure 23B:
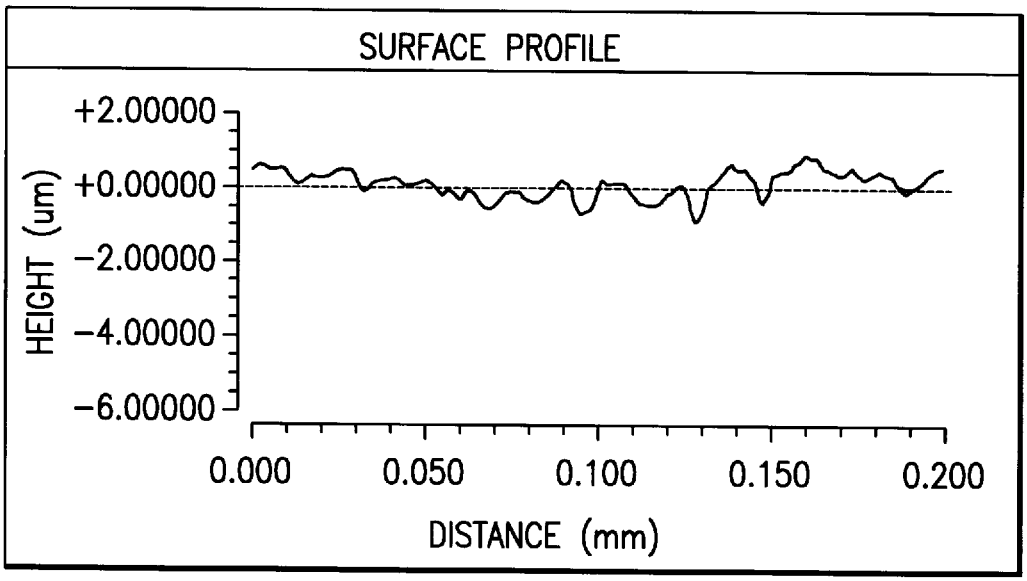

FIGS. 23*a* and 23*b* show the same coated drill before and after polishing and shows the surface profile.

Figure 24A:
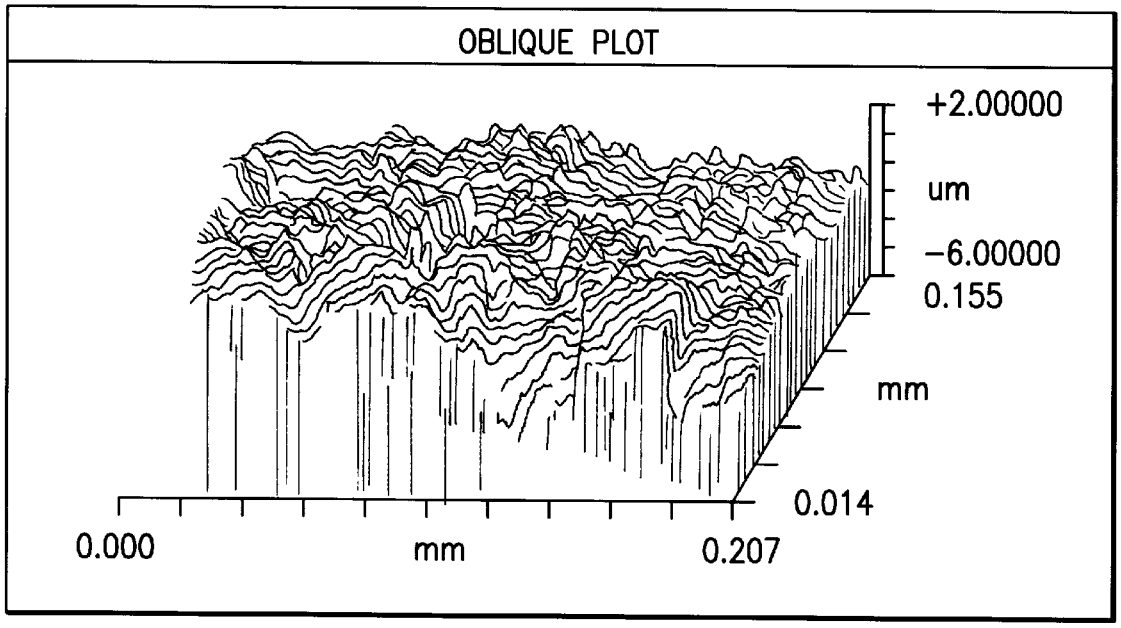
FIGS. 24*a* and 24*b* show a 3D profile of used drills before and after polishing in accordance with the present invention.
Figure 24B:
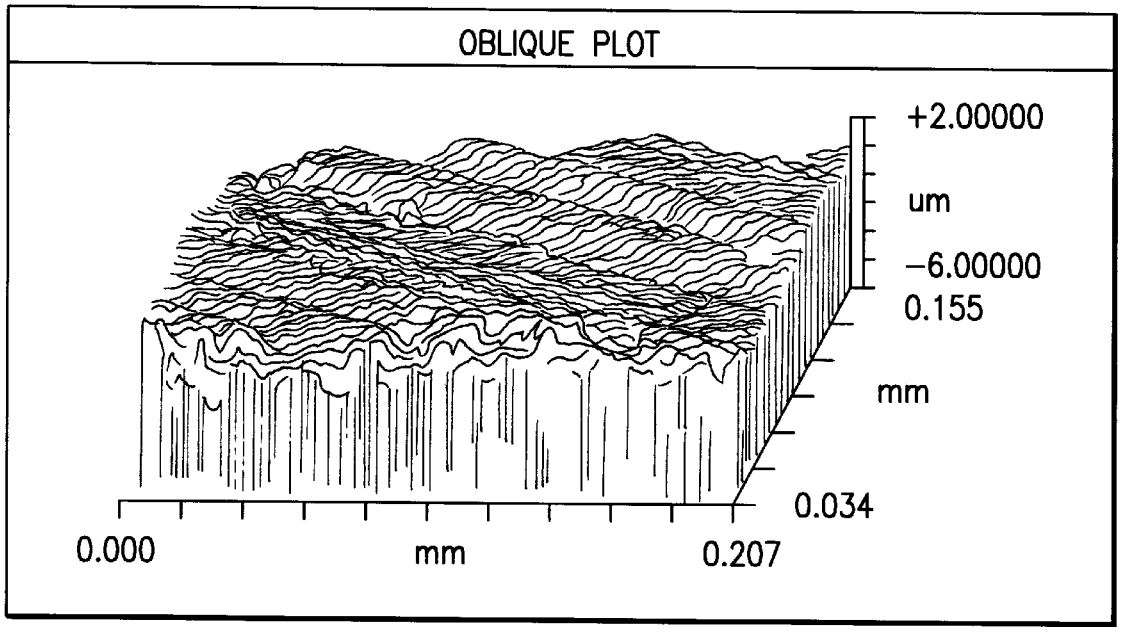
Figure 25A:
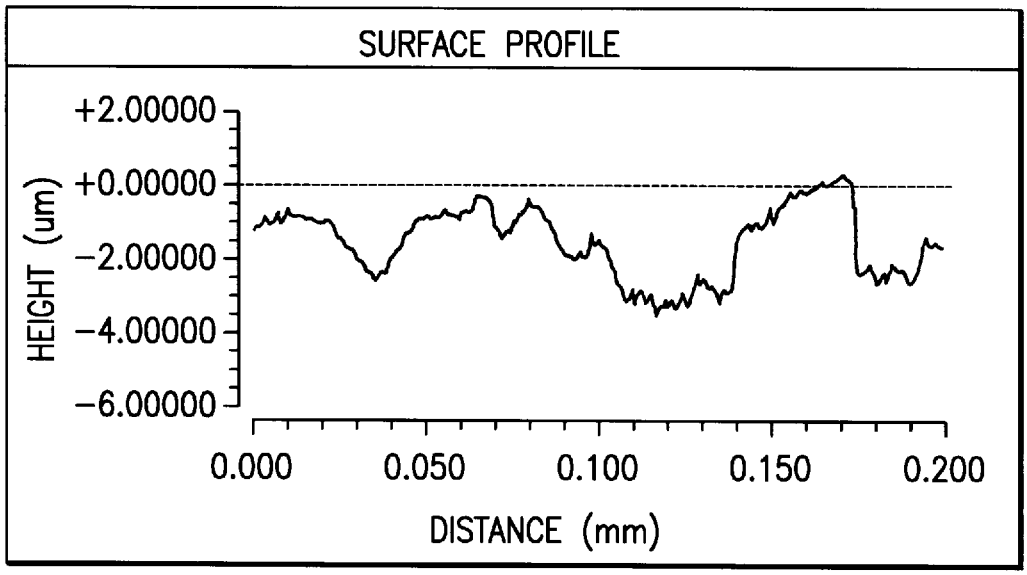
FIGS. 25*a* and 25*b* show a surface profile of used drills before and after polishing.
Figure 25B:
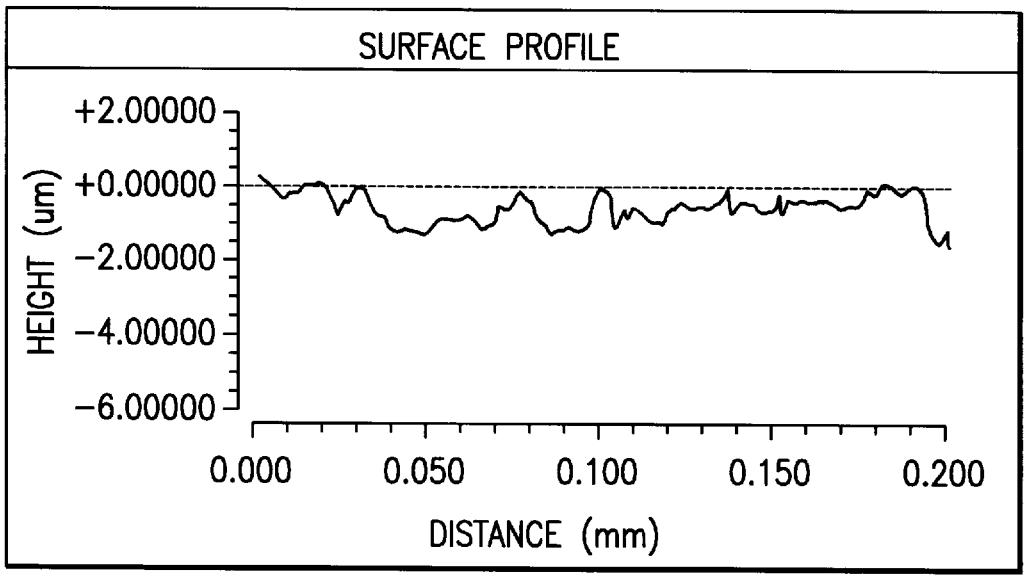
Figure 26A:
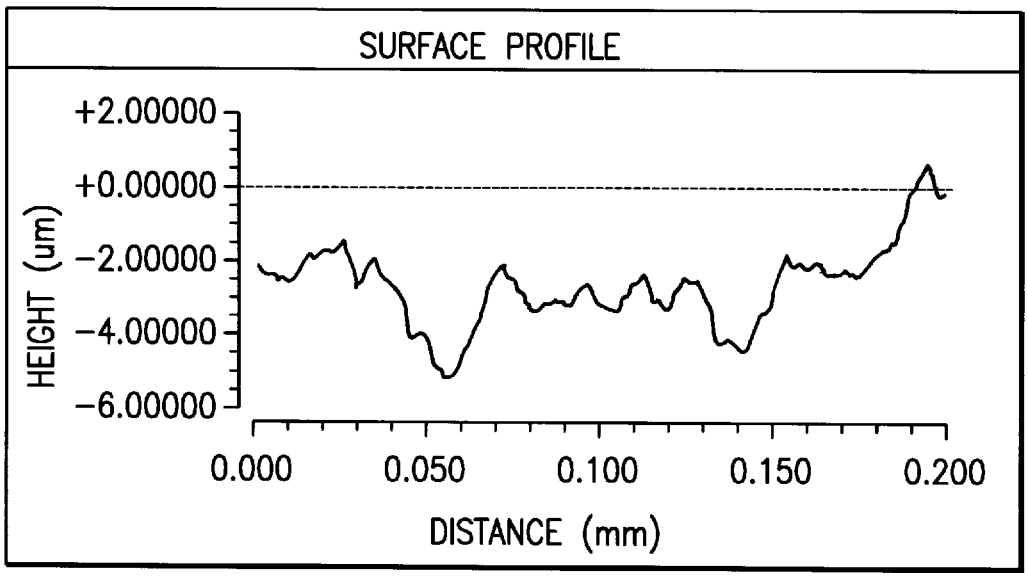
FIGS. 26*a* and 26*b* show a surface profile of used drills before and after polishing.
Figure 26B:
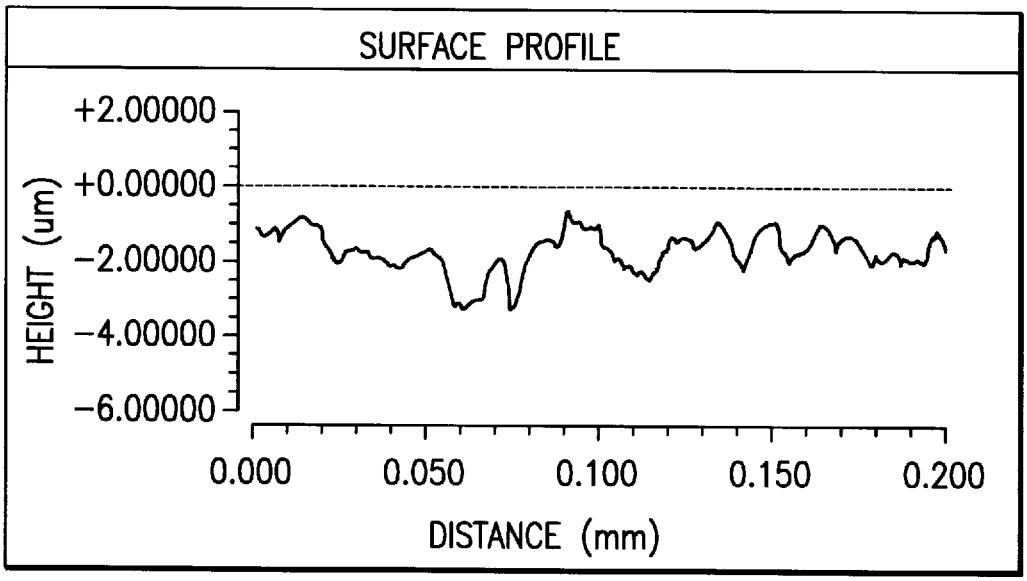
Figure 27A:
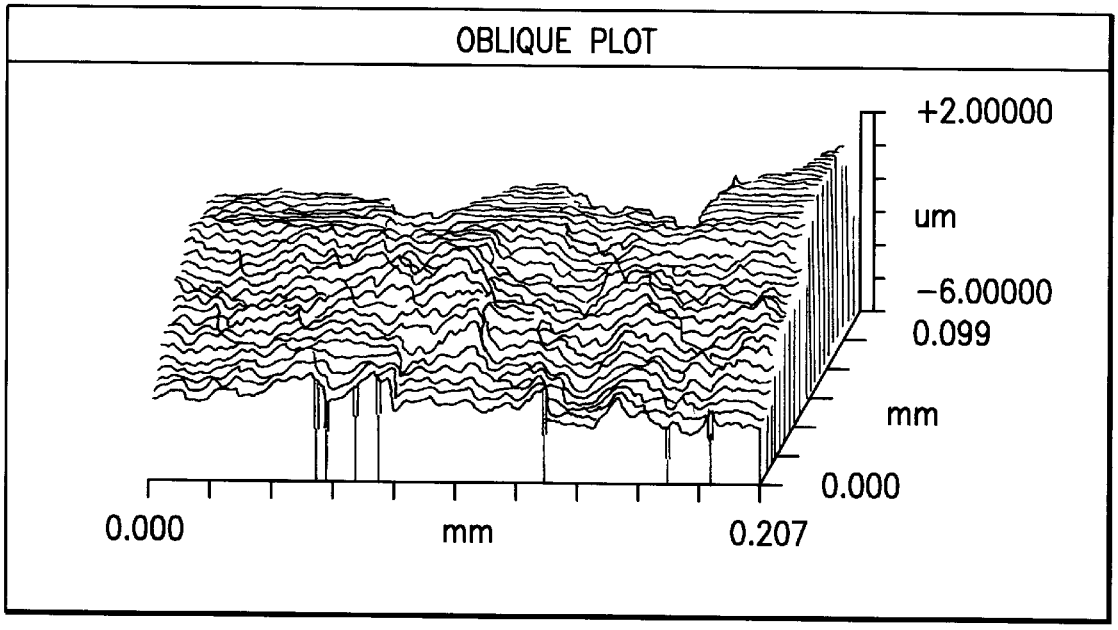
FIGS. 27*a* and 27*b* show a 3D profile of used drills before and after finishing.
Figure 27B:
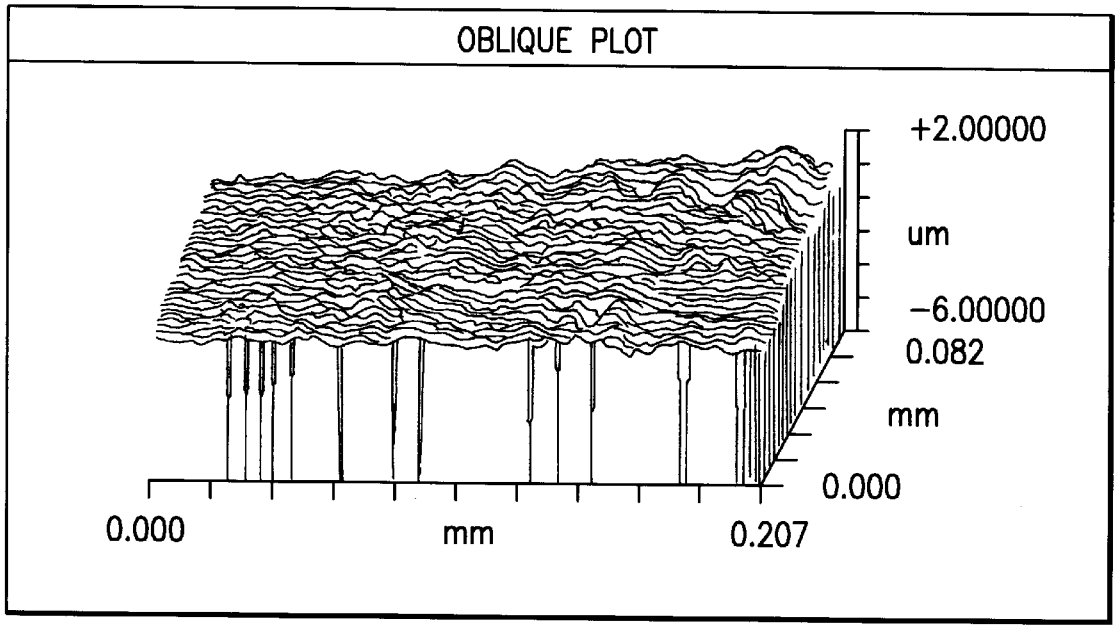

FIGS. 24*a* and 24*b* show the 3D profile and surface profile of used drills both before and after polishing.

Figure 28:
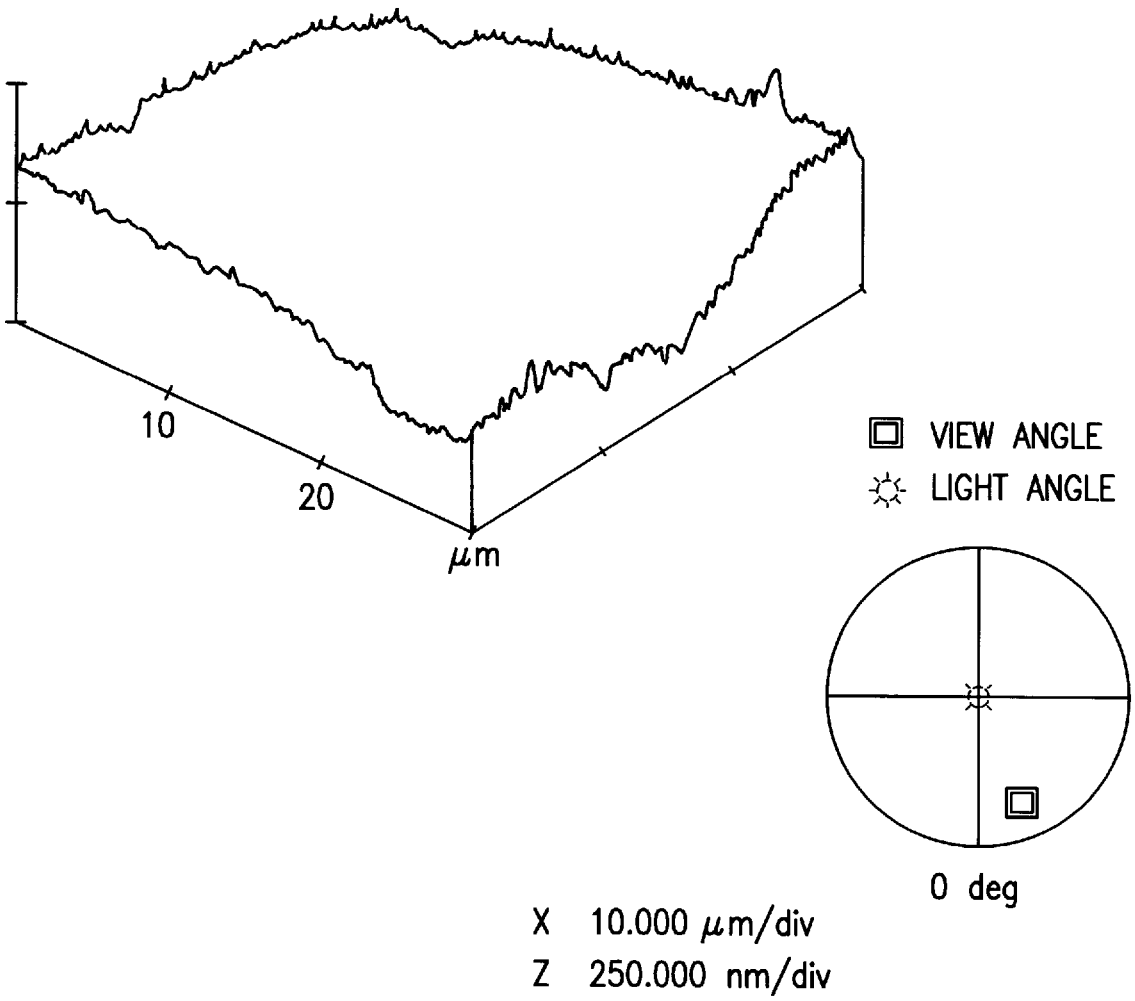
FIG. 28 shows a 3D representation of a cutter surface before polishing with the present invention.

FIG. 28 shows a 3D cutter surface before polishing.

Figure 29:
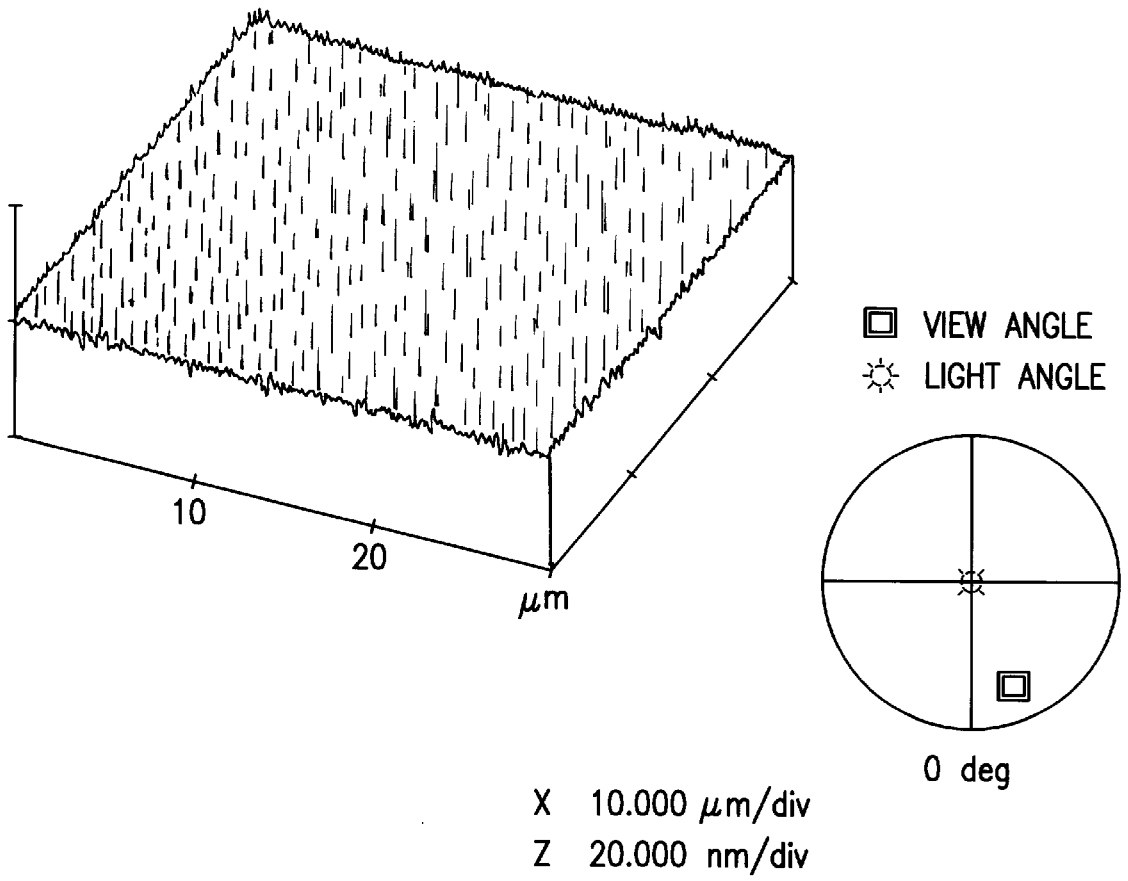
FIG. 29 shows a representation of a 3D surface of a cutter after polishing in accordance with the present invention.

FIG. 29 shows the 3D cutter surface after polishing in accordance with the present invention.

Figure 30:
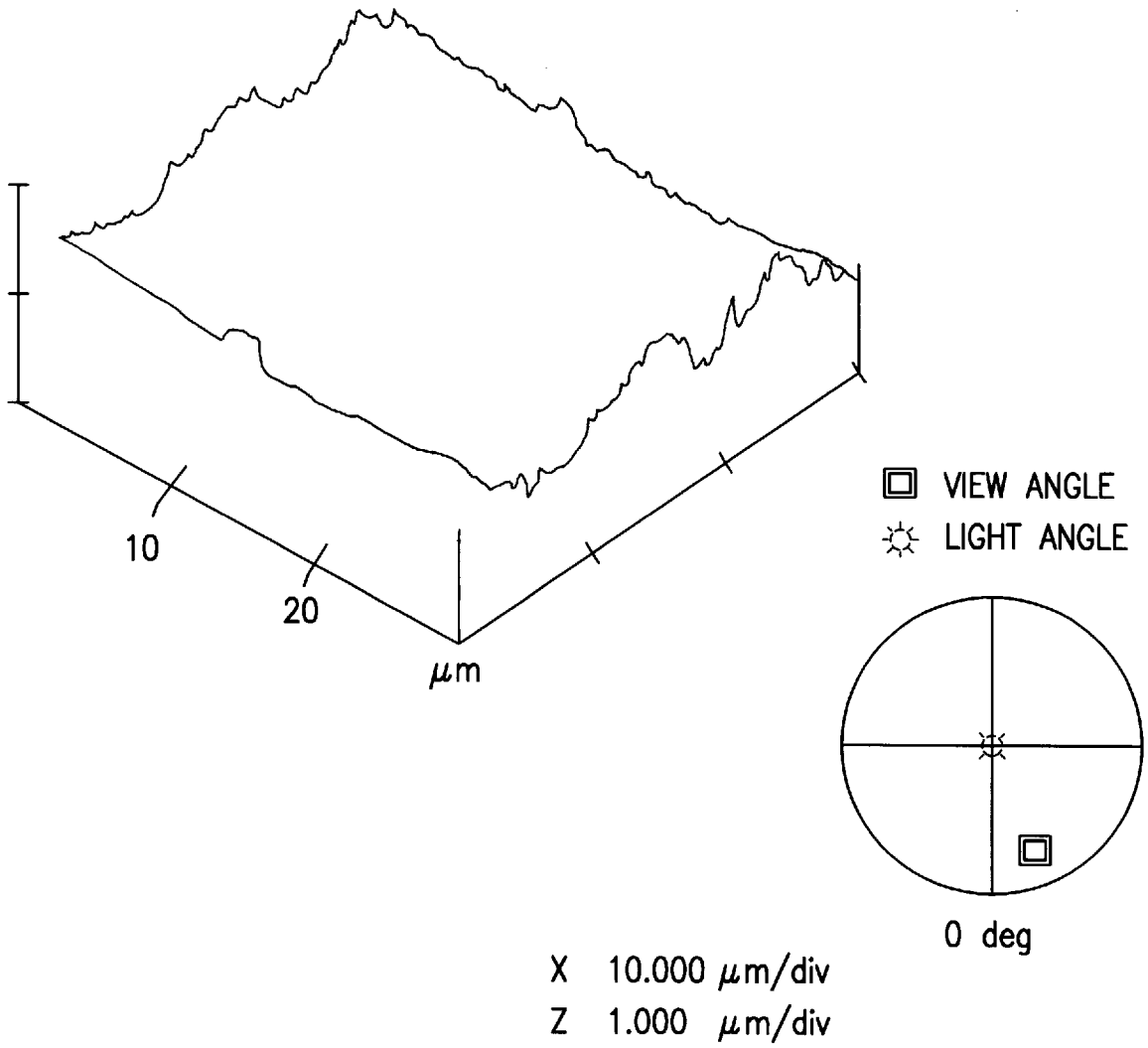
FIG. 30 shows a 3D plot of a cutting tool before polishing in accordance with the present invention.
Figure 31:
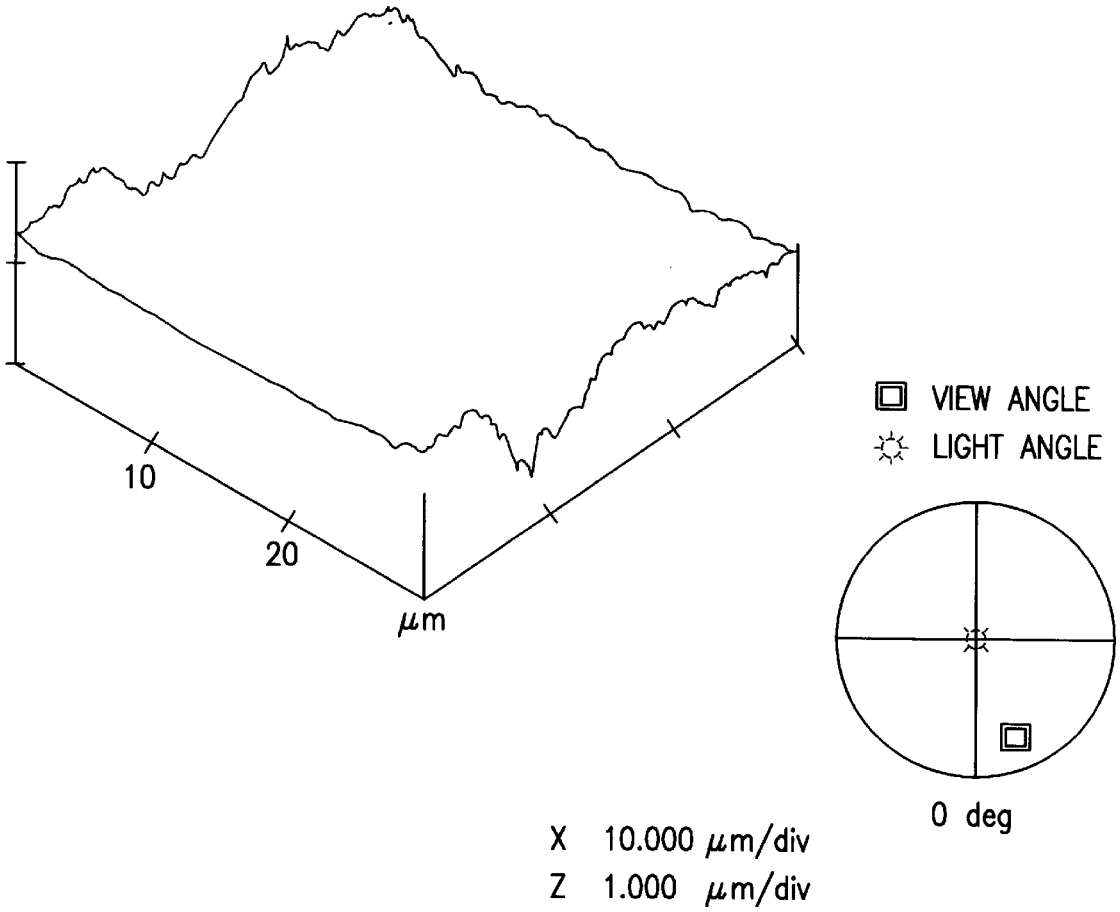
FIG. 31 shows a 3D plot of a cutting tool after polishing in accordance with the present invention.

FIG. 30 shows a 3D plot of a cutting tool before polishing while FIG. I shows the plot of a cutting tool after polishing.

Figure 32A:
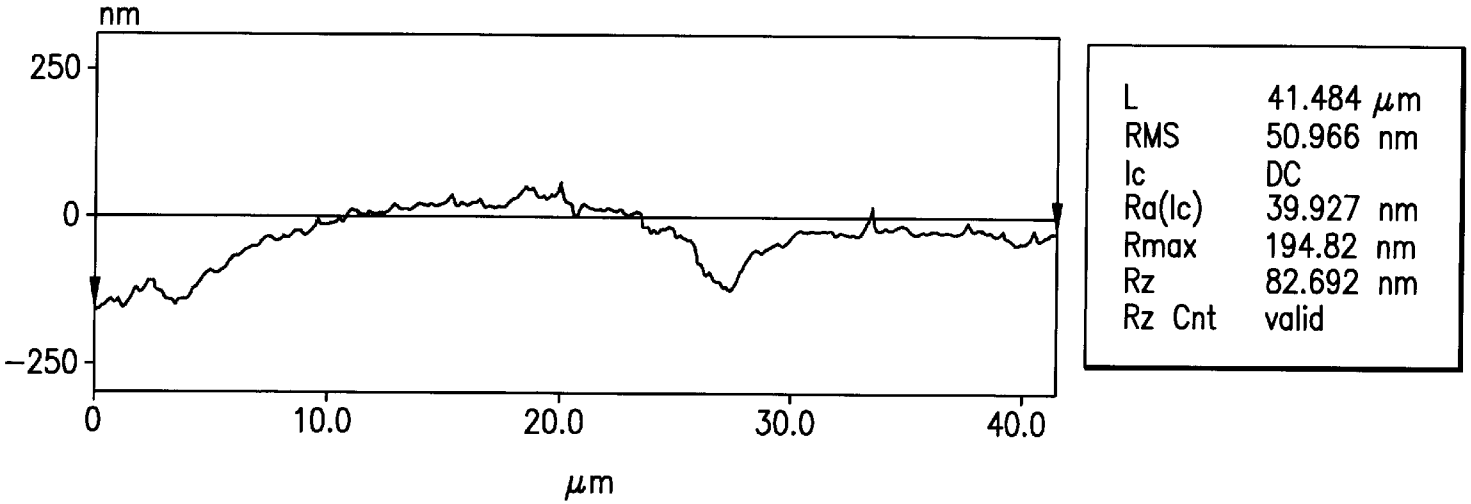
Figure 32B:
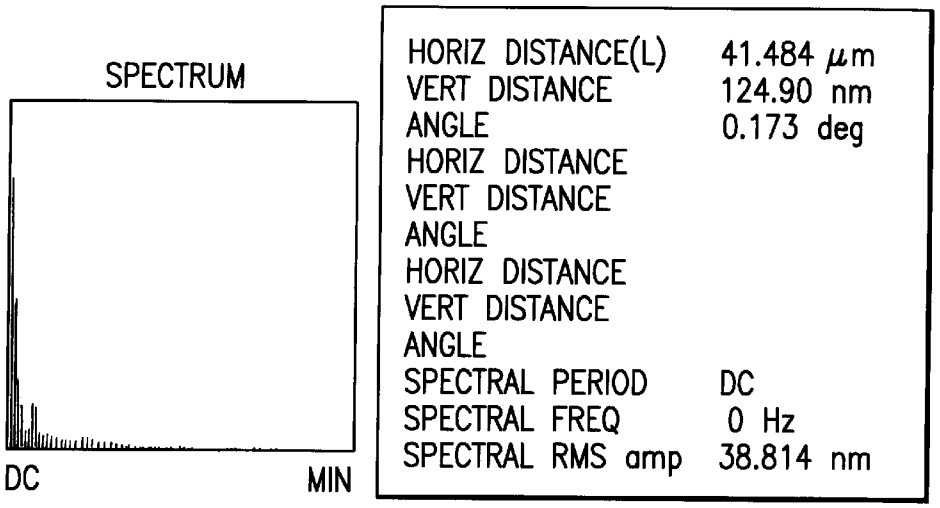
FIG. 32*b* is a spectrum of the section analysis.

FIGS. 32*a* and 32*b* show a line plot cutter surface after polishing with the section analysis shown in FIG. 32*a* and a spectrum shown in FIG. 32*b*.

Figure 33A:
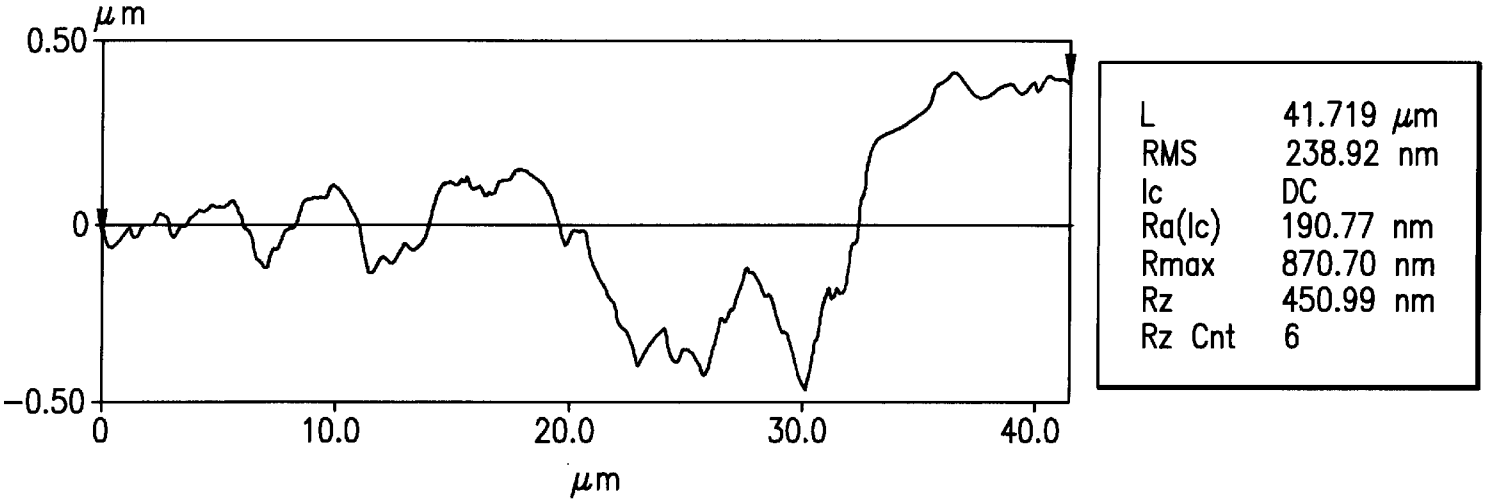
FIG. 33*a* and FIG. 33*b* show a line plot and spectrum of a cutter surface before polishing.
Figure 33B:
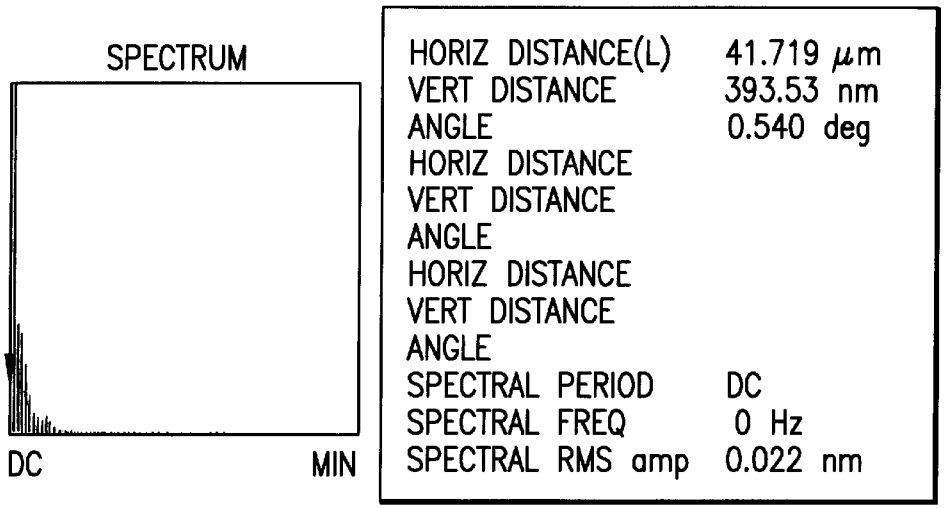

FIGS. 33*a* and 33*b* show a line plot cutter surface before polishing with the section analysis in FIG. 33*a* and a spectrum in FIG. 33*b*.

Figure 34A:
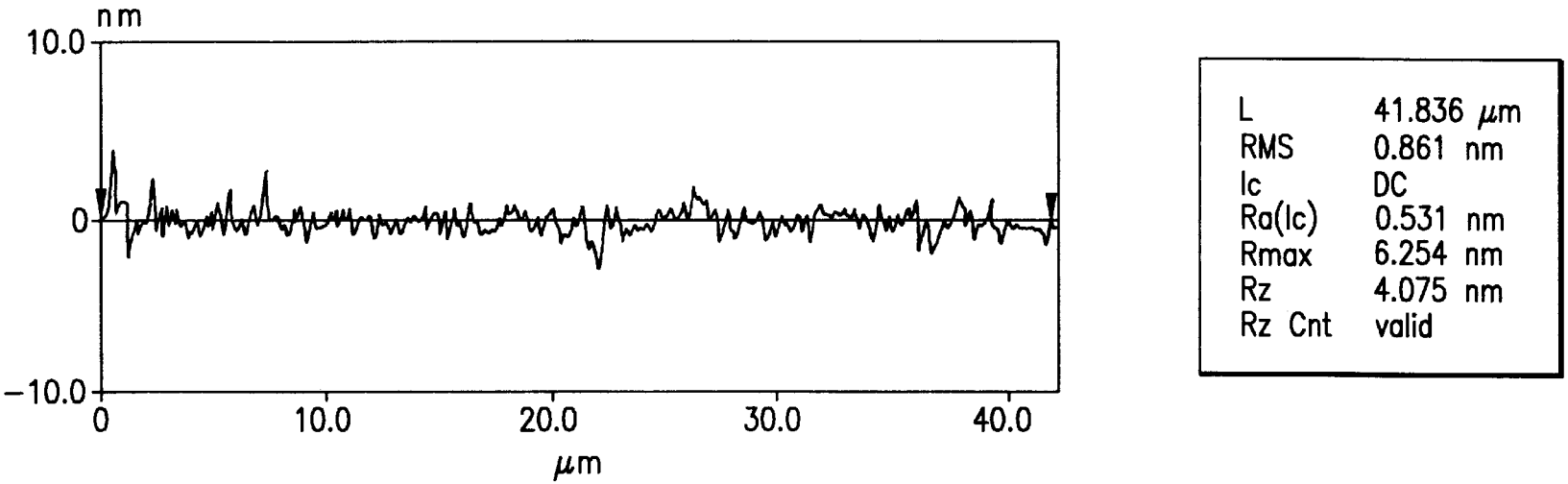
FIGS. 34*a* and 34*b* show a line plot and spectrum of a cutter surface after polishing.
Figure 34B:
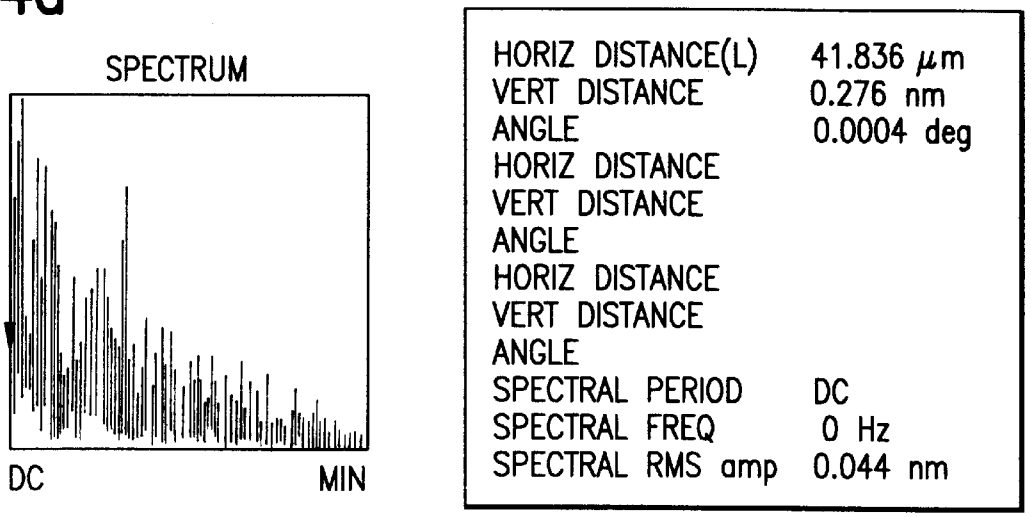

FIGS. 34*a* and 34*b* show a line plot cutter surface after polishing with the section analysis in FIG. 34*a* and a spectrum in FIG. 34*b*.

The apparatus and method of the present invention now allows for greater control over surface finishing and polishing by having a structure where an outer vessel does not have to be rotated. A traction surface is not required and less energy is required for the polishing operation as compared to prior art devices where a traction force is required. The present invention allows more efficient polishing without a necessary traction surface Extensive sound deadening is also not necessary.

What has been described is merely illustrative of the present invention. Other applications other than the disclosed apparatus and method are contemplated as being within the knowledge of one skilled in the art and may be utilized without departing from the spirit and scope of the present invention.

That which is claimed is:

1. A centrifugal finisher for finishing at least one object, comprising a fixed, nonrotatable outer vessel having an inner surface and a central axis, at least one inner vessel positioned inside the outer vessel for containing an object to be finished, said inner vessel having an outer surface, at least one intermediate roller positioned between the inner surface of the outer vessel and the outer surface of an inner vessel and engaging the surfaces of respective outer and inner vessels, and drive means for rotating an inner vessel around the central axis of the outer vessel thereby causing rotation of the inner vessel by engagement with the intermediate roller that moves along the inner surface of the outer vessel.

2. The centrifugal finisher according to claim 1 wherein said drive means comprises means for biasing the inner vessel against the intermediate roller.

3. The centrifugal finisher according to claim 1 including two intermediate rollers for engaging an inner vessel and providing two contact points against the inner surface of the outer vessel.

4. The centrifugal finisher according to claim 1 wherein said intermediate roller comprises a spool roller having opposing ends of a first diameter for engaging the inner surface of the outer vessel, and a smaller diameter medial portion that engages the outer surface of the inner vessel, wherein the rotation between the smaller diameter medial portion and the larger diameter end portions characterizes how the inner vessel rotates.

5. The centrifugal finisher according to claim 1 wherein said drive means includes a rotor arm supported for rotation at the central axis of the outer vessel, said rotor arm having an end, and a drive roller mounted on the end of the rotor arm for engaging the outer surface of the inner vessel and biasing the inner vessel against the intermediate roller.

6. The centrifugal finisher according to claim 5 including a central support positioned at the central axis of the inner vessel, a rotor arm mounted to the central support and having an end and a drive roller mounted on the end for engaging an inner vessel.

7. A centrifugal finisher for finishing at least one object, comprising a fixed, nonrotatable outer vessel having an inner surface, an outer surface, and a central axis, said inner surface including guide channels, at least one support member mounted for movement about the inner surface of the outer vessel, said support member including at least one vertically oriented spool roller rotatably mounted on the support member and having upper and lower ends and an outer surface on each end with a first diameter and configured for engaging the guide channels, and a medial portion having a diameter that is less than the diameter of upper and lower ends, an inner vessel support mounted on the support member in a position radially inward toward the central axis of the outer vessel for rotatably supporting an inner vessel into which an object is inserted for polishing, and means for rotating the inner vessel around the central axis of the outer vessel while engaging the inner vessel against the medial portion of the intermediate roller thereby causing rotation of the inner vessel by engagement of the inner vessel with the intermediate roller as the intermediate roller rotates along the inner surface of the outer vessel.

8. The centrifugal finisher according to claim 7 wherein said means for rotating the inner vessel comprises means for biasing the inner vessel against the intermediate roller while the intermediate roller engages the inner surface of the outer vessel.

9. The centrifugal finisher according to claim 7 including two intermediate rollers rotatably mounted on the support member for engaging the inner vessel and providing two contact points against the inner surface of the outer vessel.

10. The centrifugal finisher according to claim 7 wherein said means for rotating the inner roller includes a rotor arm supported for rotation at the central axis of the outer vessel, said rotor arm having an end, and a drive roller mounted on the end of the rotor arm for engaging the outer surface of an inner vessel and biasing the inner vessel against the intermediate roller.

11. The centrifugal finisher according to claim 10 including a central support positioned at the central axis of the inner vessel, a rotor arm mounted on the central support and having an end and a drive roller mounted on the end for engaging an inner vessel.

12. The centrifugal finisher according to claim 7 wherein said outer vessel includes an outer surface, and said support member includes means for supporting a guide wheel for engaging and rolling along the outer surface of the outer vessel to aid in stabilizing the support member as it moves along the outer vessel.

13. A method of centrifugal finishing comprising the steps of engaging an inner vessel into which an object to be polished is inserted against the outer surface of a respective intermediate roller that is engaged against the inner surface of a fixed, nonrotatable outer vessel having a central axis, and rotating the inner vessel around the central axis of the outer vessel and thereby causing rotation of the inner vessel.

14. A method according to claim 13 including the step of engaging the inner vessel with two intermediate rollers that engage the inner surface of the outer vessel.

15. A method according to claim 13 including rotating the inner vessel by biasing a drive roller supported on a rotor arm rotatably mounted at the central axis of the outer vessel and rotating the rotor arm and engaging the drive roller against the inner vessel.

16. The centrifugal finisher accounting to claim 1 wherein the inner vessel is removably mounted inside the outer vessel.

17. The centrifugal finisher according to claim 1 including two intermediate rollers and a drive roller mounted on the drive means for forming a cradle in which the inner vessel can be removably positioned.

* * * * *